United States Patent [19]

Ito et al.

[11] Patent Number: 4,575,227

[45] Date of Patent: Mar. 11, 1986

[54] COPYING MACHINE HAVING A CAPABILITY OF REPRODUCING IMAGES AT DIFFERENT MAGNIFICATIONS

[75] Inventors: Masazumi Ito, Toyohashi; Yutaka Irie; Yoshikazu Ikenoue, both of Toyokawa; Minoru Nakamura, Toyohashi, all of Japan

[73] Assignee: Minolta Camera Kabushiki Kaisha, Osaka, Japan

[21] Appl. No.: 561,571

[22] Filed: Dec. 14, 1983

[30] Foreign Application Priority Data

Dec. 14, 1982 [JP] Japan ..... 57-219566
Dec. 15, 1982 [JP] Japan ..... 57-220527

[51] Int. Cl.[4] ..... G03G 15/00

[52] U.S. Cl. ..... 355/56; 355/3 R; 355/14 R; 355/8

[58] Field of Search ..... 355/3 R, 14 R, 8, 55, 355/56, 57

[56] References Cited

U.S. PATENT DOCUMENTS 4,277,163 7/1981 Ikesue et al. ..... 355/56 X

FOREIGN PATENT DOCUMENTS 55-28079 2/1980 Japan .
56-154744 11/1981 Japan .
151958 9/1982 Japan .
2088572 12/1980 United Kingdom .
2089072 12/1980 United Kingdom .

*Primary Examiner*—A. C. Prescott
*Attorney, Agent, or Firm*—Price, Gess & Ubell

[57] ABSTRACT

A copying machine having the capability of reproducing an image at different magnifications from either a stored or calculated magnification ratio is provided. The size of the original and the size of the various copying papers available are calculated to determine an optimum magnification ratio. A preset value of optical magnification ratios can be provided within the copying machine. A controller can determined whether the calculated magnification ratio can be utilized within the preset predetermined range of values and corresponding control of the copier machine can be effected in accordance with that decision.

15 Claims, 26 Drawing Figures

COPYING MACHINE HAVING A CAPABILITY OF REPRODUCING IMAGES AT DIFFERENT MAGNIFICATIONS

BACKGROUND OF THE INVENTION

The present invention generally relates to a copying machine and, more particularly, to a copying machine having a capability of reproducing images at different magnifications one at a time within a predetermined range.

Japanese Laid-open Patent Publication No. 57-68868 discloses a copying machine having a capability of reproducing images at different magnifications one at a time by detecting the size of an original and that of a copying paper and selecting an optimum magnification ratio from a plurality of available magnification ratios.

Since the prior art machine is a system wherein an appropriate copying ratio is selected from a combination of the size of the original and that of the copying paper, data to be selected have to be stored in the form of a table. This means that, when the number of the sizes of copying papers useable in the machine and the number of the available magnification ratios increase, the capacity of a storage device must be correspondingly increased for storing the table. In addition, there has been found a problem residing in that, when the number of the available magnification ratios is small, the magnification at which the image on an A-4 sized original is reproduced on a B-5 sized copying paper is, for example, treated as applicable to the magnification at which the image on a B-4 sized original is reproduced on an A-4 sized copying paper.

SUMMARY OF THE INVENTION

Accordingly, the present invention has been developed with a view to substantially eliminate the above discussed problem and has for its object to provide a copying machine capable of reproducing the original image at any desired magnification within a predetermined range of magnification ratio.

According to the present invention, the size of an original and that of a copying paper are utilized to calculate an optimum magnification and the calculated magnification is, if within the predetermined range, set in a means for setting such magnification. Accordingly, with no need to increase the number of numerical figures to be stored as magnification data, and also with no need to limit the way of using the original and the copying paper, any desired magnification can be automatically and efficiently set in the machine. For this purpose, the copying machine according to the present invention is provided with means for detecting the size of an original, means for discriminating the size of a copying paper, a magnification control means for controlling at least an optical system of the machine so as to enable a copying operation to be executed at any magnification within a predetermined range of magnification ratio, a magnification setting means for giving to the magnification control means such data as concerned with the magnification, means for calculating the desired magnification from the detected size of the original and the discriminated size of the copying paper, and a control means for setting the data of the calculated magnification in the magnification control means when the calculated magnification is within the predetermined range.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE EMBODIMENTS

Figure 1:
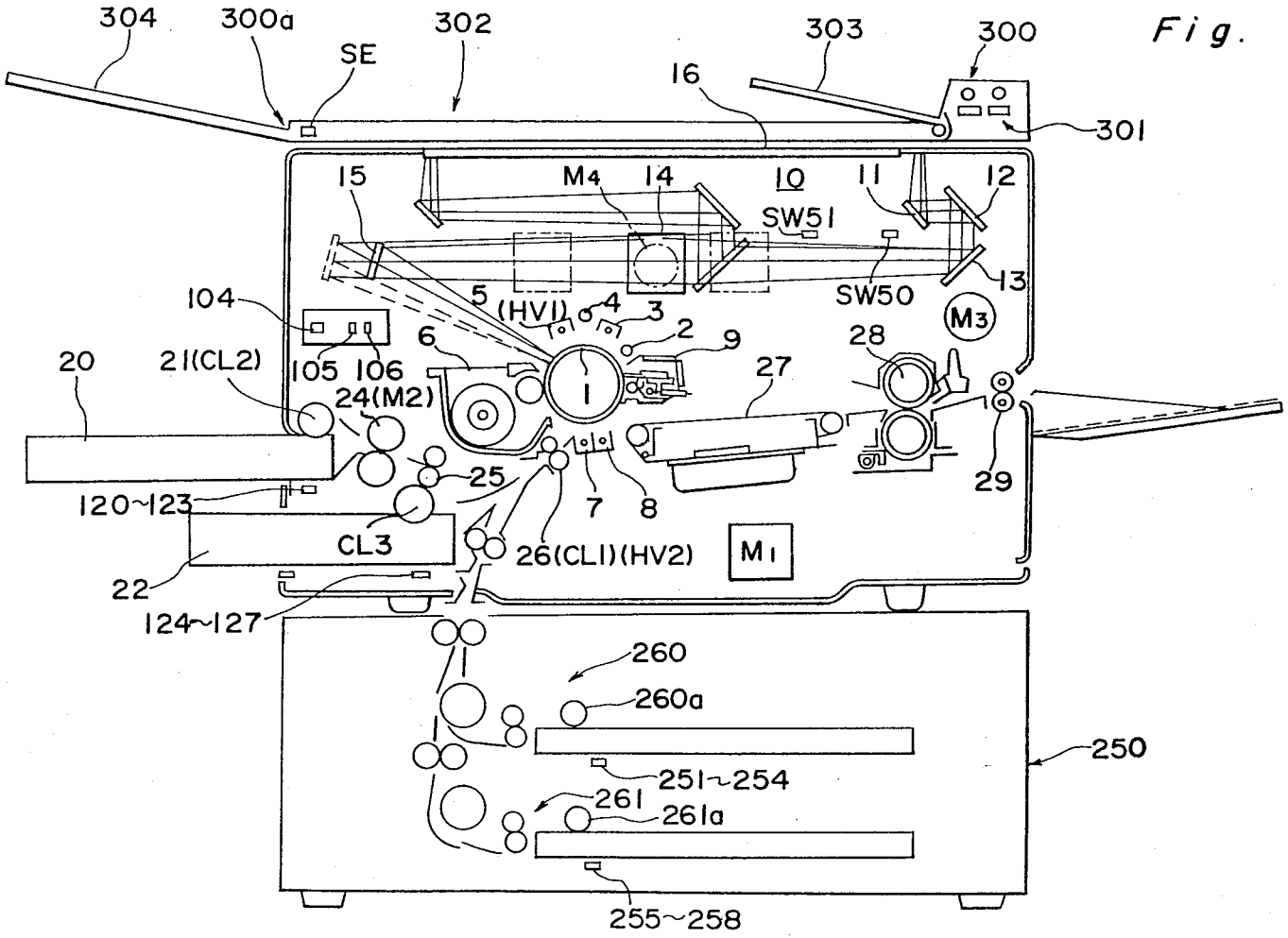
FIG. 1 is a schematic diagram showing an electrophotographic copying machine embodying the present invention.

Before the description of the present invention proceeds, it is to be noted that like parts are designated by like reference numerals throughout the accompanying drawings.

Copying Mechanism

Referring first to FIG. 1, an electrophotographic copying machine to which the present invention is applied comprises a photoreceptor drum 1 supported at a generally central portion within a machine housing for rotation in a direction counterclockwise as viewed therein. The machine also comprises a main eraser lamp 2, an auxiliary electrostatic charger 3, an auxiliary eraser lamp 4, a main electrostatic charger 5, a developing unit 6, a transfer charger 7, a separator charger 8 for facilitating the separation of a copying paper from the drum 1, and a blade-type cleaning unit 9, all disposed adjacent to and around the drum 1 within the machine housing. The photoreceptor drum 1 is of a construction having its outer peripheral surface provided with a photosensitive layer which, as it moves past the eraser lamps 2 and 4 and the electrostatic chargers 3 and 5 during the rotation of the drum 1, can be highly sensitized and electrostatically charged in readiness for its exposure to an image transmitted by means of an optical system 10.

The optical system 10 is supported underneath a transparent original support glass 16 for scanning an original on the support glass 16 from below and includes a light source (not shown), movable mirrors 11, 12 and 13, a projector lens assembly 14 and a mirror 15. The light source and the mirrors 11 to 13 are adapted to be driven by a DC motor M3 in such a way that both the light source and mirror 11 and both of the mirrors 12 and 13 can be moved leftwards, as viewed in FIG. 1, at a predetermined speed of V/n and at a predetermined speed of V/2n, respectively, wherein V represents the peripheral velocity of the drum 1 which is fixed regardless of the magnification and n represents the magnification. It is to be noted that, when the magnification is changed, not only is the lens assembly 14 moved in a direction parallel to the optical axis thereof, but also the movable mirror 15 is moved and tilted, and a positioning mechanism necessary to accomplish these movements is hereinafter described.

At a left-hand portion of the machine housing, the machine is provided with paper supply units 20 and 22 including respective paper supply rollers 21 and 23, the path of travel of each copying paper being defined by roller pairs 24 and 25, a timing roller pair 26, a transfer belt 27, a fixing unit 28 and an ejector roller pair 29.

Referring still to FIG. 1, reference numeral 300 represents an auto-paper select mode selector switch and its indicator in an auto-document feeder unit (hereinafter referred to as ADF unit) 300, and reference numeral 301 represents an auto-scale select mode selector switch and its indicator in the ADF unit 300. In the illustrated machine, reference numerals 120 to 123 represent respective paper code (size) detector switches for an A paper supply unit, and reference numerals 124 to 127 represent respective paper code detector switches for a B paper supply unit. In a base box 250, reference numerals 251 to 254 represent respective paper code detector switches for a C paper supply unit, and reference numerals 255 to 258 represent respective paper code detector switches for a D paper supply unit. The size of each of a plurality of batches of copying papers contained in the respective paper supply units can be, when the respective detector switch is actuated on or off by an associated actuating member (not shown) provided in a respective paper cassette, detected in the light of the code table which is shown in Table 1 as will be described later. The data shown in Table 1 are stored in a read-only memory or the like.

The ADF unit 302 is placed on the original support 16, and an original bearing an image to be copied can be brought to a definite position above the original support 16 by the ADF unit 302 when it is inserted from a tray 304 with the image to be copied facing downwards. After the copying operation, the ADF unit 300 ejects the original onto a tray 303 having inverted the original. Accordingly, the copying machine and the ADF unit are associated with each other so that the machine will not start during the transport of the original and, also, the original will not be transported during the scanning being performed in the machine. The ADF unit 300 has a plurality of sensors SE positioned and arranged adjacent an original intake opening 300*a* thereof, with which sensors SE the width and the length of the original can be detected during the transportation of the original.

The base box 250 concurrently serves as a support bench for the support of the machine proper thereon and is provided therein with paper supply mechanisms 260 and 261. By a command supplied from a microcomputer in the machine proper, paper supply rollers 260*a* and 260*b* are selectively driven one at a time. In such case, a paper supply start signal for initiating the supply of a copying paper must be outputed at a timing earlier than that to be supplied to each of the paper supply rollers within the machine proper.

Figure 3:
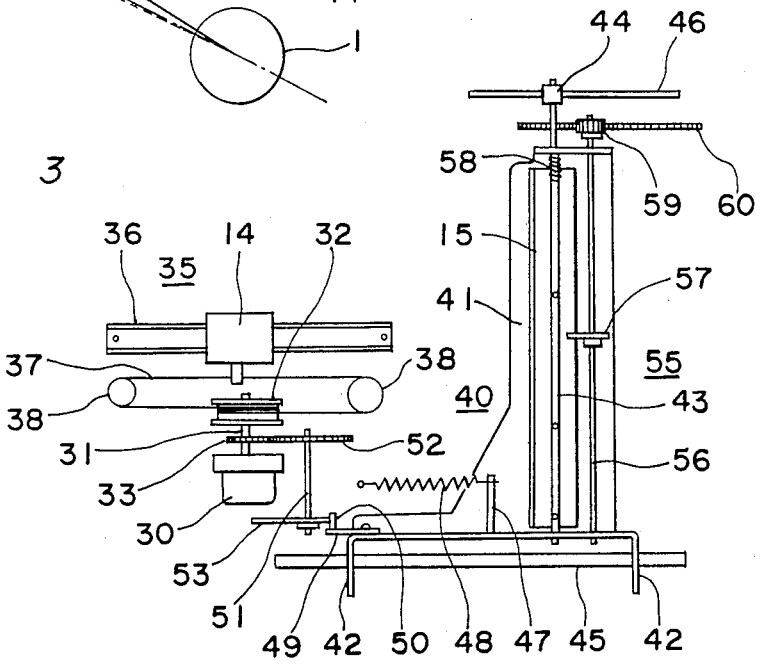
FIG. 3 is a schematic top plan view showing a mirror positioning mechanism used in the machine.
Figure 4:
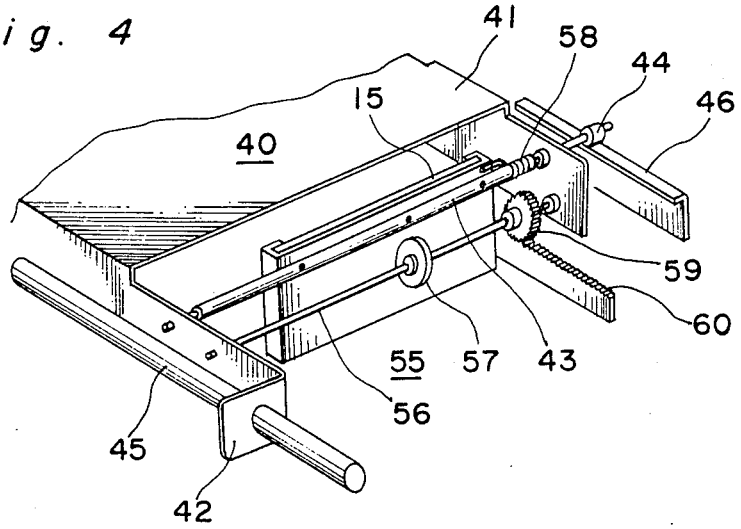
FIG. 4 is a perspective view of a mirror tilting mechanism used in the machine.

The positioning mechanism for the lens assembly and the movable mirrors for effecting the change in magnification or scale will now be described with reference to FIGS. 3 and 4. This positioning mechanism permits the substantially continuous selection of the magnification or scale from enlargement to reduction and, specifically, the selection of one of the magnifications ranging from enlargement (×1.414 scale) to reduction (×0.647 scale) through an equal size magnification (×1.0 scale).

The positioning mechanism generally comprises a lens repositioning mechanism 35, a mirror repositioning mechanism 40, a mirror tilting mechanism 55, and a stepping motor M4 for driving these.

The lens repositioning mechanism 35 is of a construction wherein the lens assembly 14 is movably mounted on a guide rail 36 arranged so as to extend in a direction parallel to the optical axis of the lens assembly 14 and a drive wire 37 turned around a drive pulley 32 fast with a device shaft 31 of the stepping motor M4 is trained between rotatably supported pulleys 38 with a substantially intermediate portion of said wire 37 rigidly connected to the lens assembly 14. Accordingly, it will readily be seen that, when the motor M4 is rotated a required number of turns in either one of the opposite directions, the drive wire 37 travels in one of the opposite directions to pull the lens assembly 14 along the guide rail 36 towards one of the plural positions according to the selected magnification or scale.

The mirror repositioning mechanism 40 is of a construction wherein the mirror 15 is mounted on a shaft 43, rotatably journalled by a carriage 41, with its backside rigidly secured thereto and with a freely rotatable roller 44 on one end of the shaft 43 resting on an auxiliary guide rail 46 while a guide rod 45 extending in a direction parallel to the optical axis slidingly extends through a pair of spaced bearing lugs 42 integral with the carriage 41. A pin 50 carried by the carriage 41 through a bracket 49 contacts the peripheral face of a drive cam 53 by the action of a coil spring 48 connected at one end to a pin 47 so as to urge the carriage 41 towards the cam 53. A drive gear 33 rigidly mounted on the output shaft 31 of the motor M4 is meshed with a driven gear 52 mounted rigidly on a support shaft 51 on which the cam 53 is also rigidly mounted in spaced relation thereto.

Figure 2:
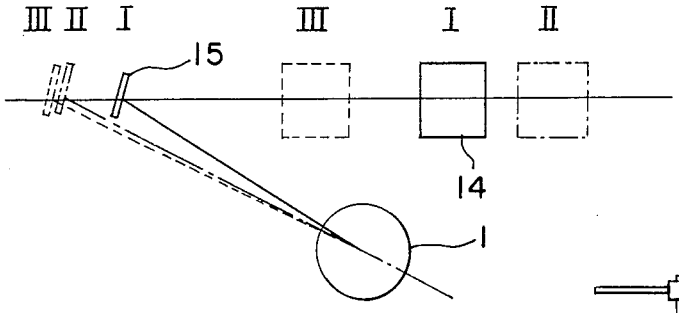
FIG. 2 is a schematic diagram showing the position of a lens assembly in the machine relative to the magnification ratio.

Thus, it is clear that the rotation of the motor M4 can be transmitted through the gears 33 and 52 and the support shaft 51 to the cam 53 wherefore the carriage 41 and, hence, the mirror 15 can be moved in a direction parallel to the optical axis to compensate for change in distance of the optical path resulting from change in magnification. In other words, the lens assembly 14 and the mirror 15 are associatedly driven by the motor M4 incident to the change in magnification, the relationship in position of them being such as shown in FIG. 2 wherein I, II and III represent the position at which equal size reproduction takes place, the position at which enlargement takes place, and the position at which reduction takes place.

The mirror tilting mechanism 55 is of a construction wherein a cam member 57 rigidly mounted on a support shaft 56 which is rotatably journalled at its opposite ends by the carriage 41 and has a pinion gear 59 rigidly mounted on the shaft 56 and meshed with a rack gear 60 fast with the machine proper and extending in a direction parallel with the guide rod 45 has its outer periphery contacting the backside face of the mirror 15 while the latter is biased towards the cam member 57 about the shaft 43 by the action of a torsion spring 48 mounted on the shaft 43. This mirror tilting mechanism 55 serves to compensate for deviation of the optical axis of a bundle of rays of light reflected by the mirror 15 from an exposure point on the drum 1, which deviation would occur when the mirror 15 is merely moved incident to a change in magnification. That is, when the carriage 41 is moved in either one of the opposite directions in parallel to the optical axis of the lens assembly 14 incident to a change in magnification, the pinion gear 59 rolls over the rack gear 60 with the cam member 57 consequently rotating together with the support shaft 56, causing the mirror 15 to tilt about the shaft 43 according to the contour of the cam member 57 to align the light rays with the exposure point on the drum 1.

The angle through which the mirror 15 can tilt about the shaft 43 is such that, at the maximum available magnification ratio (enlarged scale in the illustrated embodiment) the optical axis of the bundle of light rays reflected by the mirror 15 can be so positioned as to travel towards the center of the drum 1, but at any magnification ratio smaller than the maximum available one the optical axis can be adjusted so as to be directed towards the same exposure point as that during the operation at the maximum available magnification ratio. This is for the purpose of minimizing the distortion of the exposed image, which would result from deviation of the angle of incidence, by allowing the optical axis, which is obtained during the operation at the maximum available magnification ratio at which the distortion of the exposed image tends to be considerable, to impinge upon the drum 1 at right angles thereto since the image of a slit is enlarged when it is projected onto the drum 1.

Control Apparatus

Figure 5:
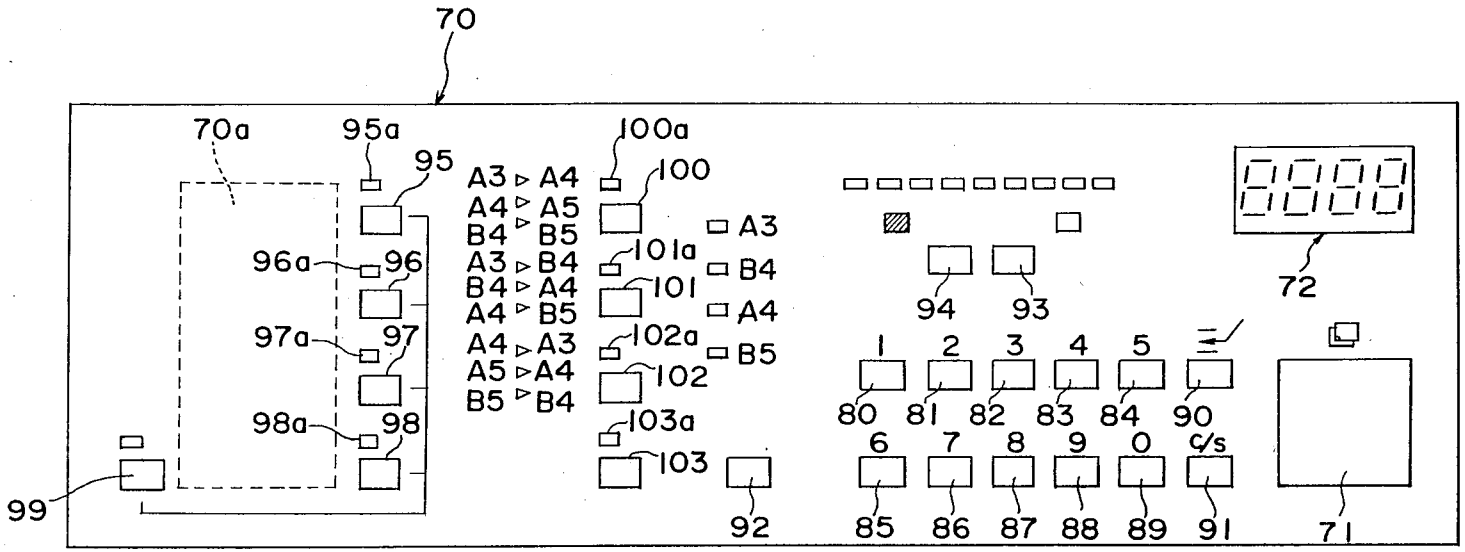
FIG. 5 is an elevational view showing an operating panel in the machine.

The manner in which various operating keys are arranged in a control panel of the copying machine is illustrated in FIG. 5. The control panel 70 shown therein is provided with a print key 71 for initiating the copying operation, a digital display device 72 capable of displaying a numerical figure comprised of up to four digits, a group of numerical input keys 80 to 89 corresponding respectively to decimal digits "1", "2"... "9", and "0", an interruption key 90 for specifying an interrupted copying operation, a clear/stop key 91, a paper selector key 92 for specifying any one of multi-staged stacks of copying papers in terms of size, up and down keys 93 and 94 for stepwisely changing the density of the image copied on the copying paper, and groups of keys 95 to 103 associated with a magnification setting device.

The first group of magnification setting keys 95 to 98 are provided for setting a desired magnification ratio and, when one of them is depressed while the control mode of the copying machine has been switched over to a first magnification setting mode by depressing the key 99 for switching over to the first magnification setting mode, a numerical figure inputed through the numerical input keys and then displayed in the display device 72 can be stored as a magnification ratio in a memory associated with such one of the keys 95 to 98 which have been depressed.

The second group of magnification setting keys 100 to 103 have associated therewith memories in which respective magnification ratios are set, and are so designed as to permit the copying operation to be executed at the preset value with no need to set a numerical value such as carried out by depressing one or some of the first group of the magnification setting keys. Accordingly, the preset magnification ratios are those selected by the manufacturer or its servicing worker according to the destination to which the copying machine is shipped and corresponding to those magnification ratios most used at such destination. This will be described later.

Thus, the first and second groups of the magnification setting keys perform different functions in such a manner that, while the first group of the magnification setting keys are utilizeable by an operator of the copying machine to set a desired magnification ratio, the second group of the magnification setting keys are utilizeable by the operator to select a preset magnification ratio, for example, A4→B5, B4→A4, A3→A4 or A4→A3 where the machine is designed for use in Japan. Yet, since the values preset respectively for the second group of the magnification setting keys are magnification ratios generally employed or calculated, it often occurs that the image copied is reproduced at a magnification somewhat different from the preset magnification ratio because of an error in the machine or design. By way of example, even though the equal size reproduction (×1 magnification) is selected, the actual magnification would be ×1.004 magnification or ×0.996 magnification. In such case, a desired magnification can be obtained by manipulating a key 104 shown in FIG. 1 for switching over to the second magnification setting mode to render the control mode of the copying machine to be switched over to the second magnification setting mode and then setting arbitrary values in memories associated with the keys 100 to 103 in a manner similar to that during the first magnification setting mode. Specifically, for a key for the ×1 magnification, a value 1.002 or 0.998 can be set.

Figure 6:
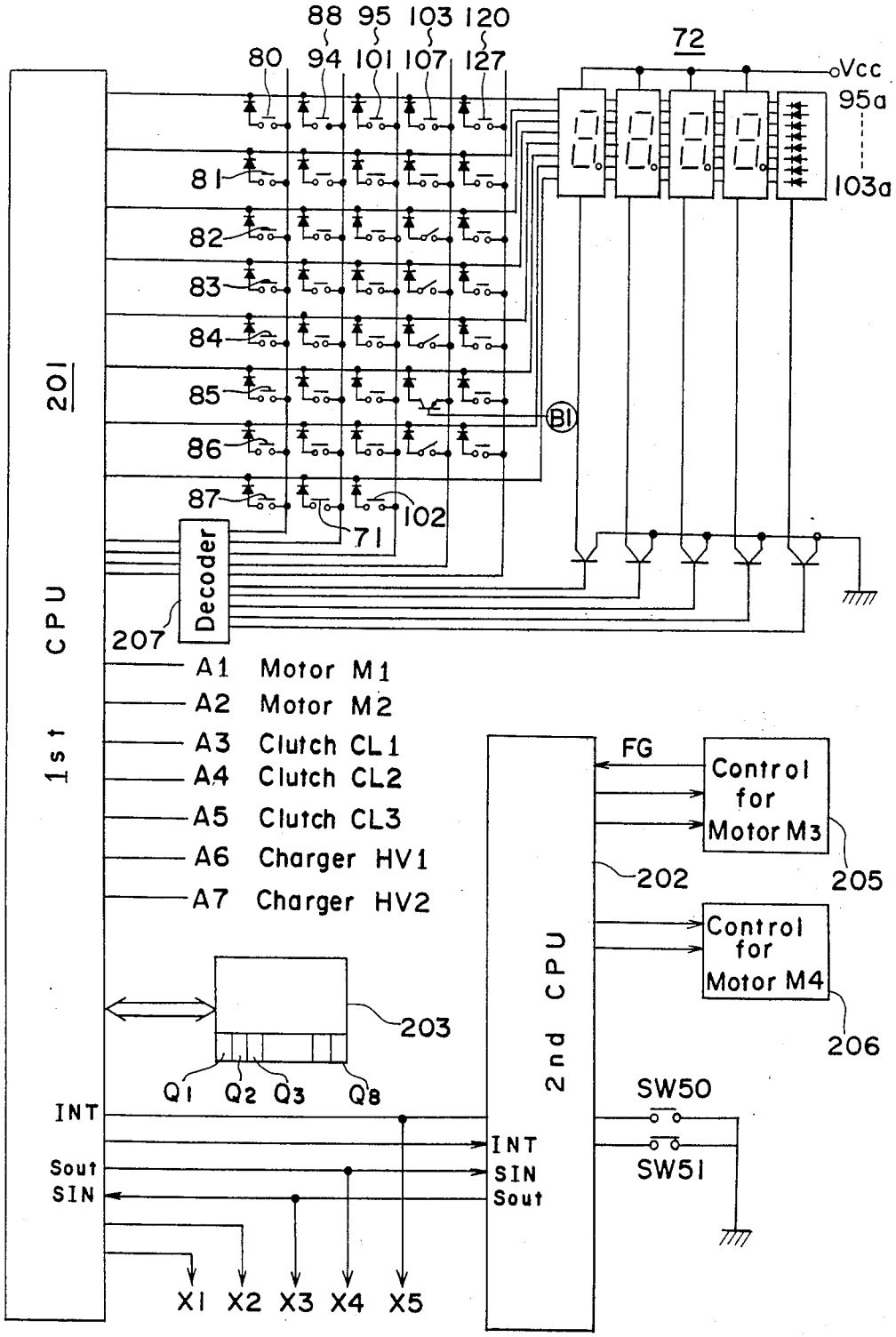
FIG. 6, comprised of FIGS. 6(*a*) and 6(*b*), is a block diagram showing one embodiment of the present invention.
Figure 6B:
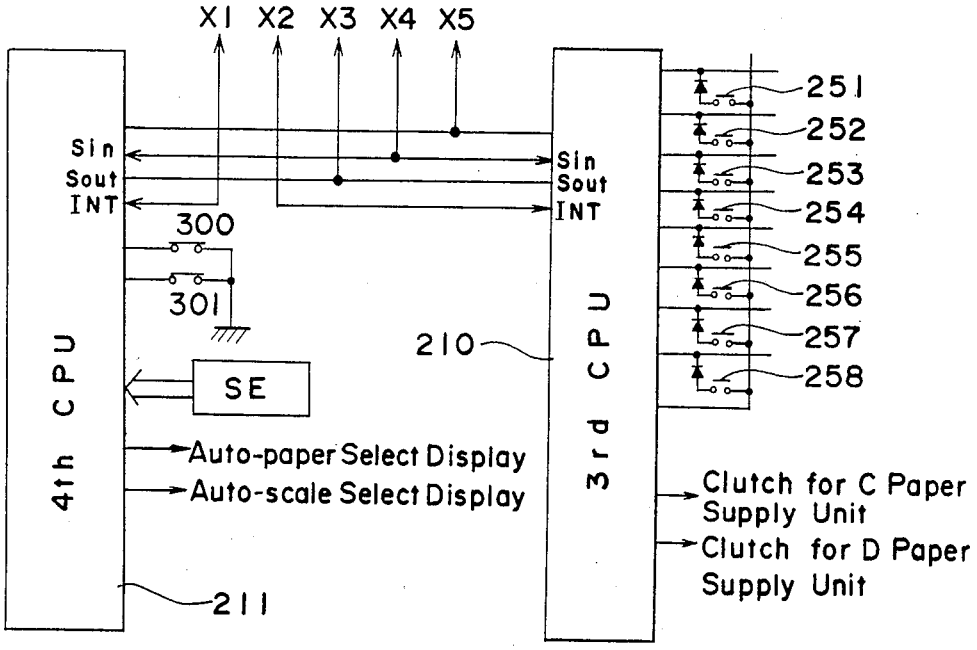
Figure 7:
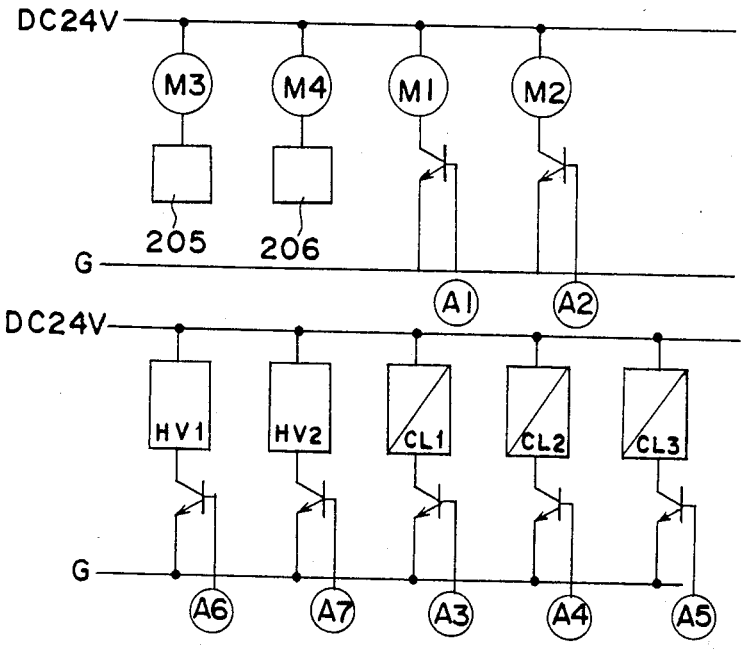
FIG. 7 is a circuit diagram showing an output circuit used in the embodiment of FIG. 6.

FIG. 6, comprised of FIGS. 6(*a*) and 6(*b*), illustrates a control circuitry used in the magnification setting device. The control circuitry shown therein comprises a second CPU 202 for controlling the optical system, a third CPU 210 for controlling the paper supply units, and a fourth CPU 211 for controlling the ADF unit. A first CPU 201 is associated with and controls the second to fourth CPUs 202, 210 and 211 with which it is connected through an interruption terminal INT and data input and output terminals Sin and Sout. The control circuitry also comprises a random access memory (RAM) 203 backed up by a battery, a switch matrix 204, a drive circuit 205 for the DC motor M3 for the original scanning, a drive circuit 206 for the stepping motor M4 for effecting the magnification adjustment, and a decoder 207. Output terminals A1 to A7 are connected to respective drive switching transistors associated with a main motor M1, a developer motor M3, a timing roller clutch $CL_1$, an upper paper supply clutch $CL_2$, a lower paper supply clutch $CL_3$, the charger 5, and the transfer charger 7, respectively, as shown in FIG. 7.

The RAM 203 stores various data for controlling the sequence of copying operation which are written therein or shifted from a read-only memory (ROM) in the CPU, and includes memories Q1, Q2, Q3 and Q4 in association with the selector keys 100 and 103. This RAM is so designed that, as will be described later, the scale or magnification ratio displayed in the display device 72 can be read in or out from memory Q1 or memory Q2 when, for example, the selector key 100 is turned on or when the selector key 101 is turned on, respectively.

In association with the selector keys 95 and 98, memories Q5, Q6, Q7 and Q8 are provided in a manner similar to memories Q1 to Q4 and, when, for example, the key 95 is turned on, the scale or magnification ratio can be read in or out from memory Q5. Codes corresponding to different sizes of copying papers are tabulated in Table 1.

TABLE 1

| Decimal Codes | Binary Codes | | | | | Paper Size |
|---|---|---|---|---|---|---|
| 0 | 0 | 0 | 0 | 0 | | |
| 1 | 0 | 0 | 0 | 1 | A-6 | Longitudinal Positioned |
| 2 | 0 | 0 | 1 | 0 | B-6 | " |
| 3 | 0 | 0 | 1 | 1 | A-5 | " |
| 4 | 0 | 1 | 0 | 0 | B-5 | " |
| 5 | 0 | 1 | 0 | 1 | A-4 | " |
| 6 | 0 | 1 | 1 | 0 | B-4 | " |
| 7 | 0 | 1 | 1 | 1 | A-3 | " |
| 8 | 1 | 0 | 0 | 0 | | |
| 9 | 1 | 0 | 0 | 1 | A-5 | Latitudinal Positioned |
| 10 | 1 | 0 | 1 | 0 | B-5 | " |
| 11 | 1 | 0 | 1 | 1 | A-4 | " |
| 12 | 1 | 1 | 0 | 0 | B-4 | " |
| 13 | 1 | 1 | 0 | 1 | A-3 | " |
| 14 | 1 | 1 | 1 | 0 | | |
| 15 | 1 | 1 | 1 | 1 | Cassette Empty | |

Figure 19:
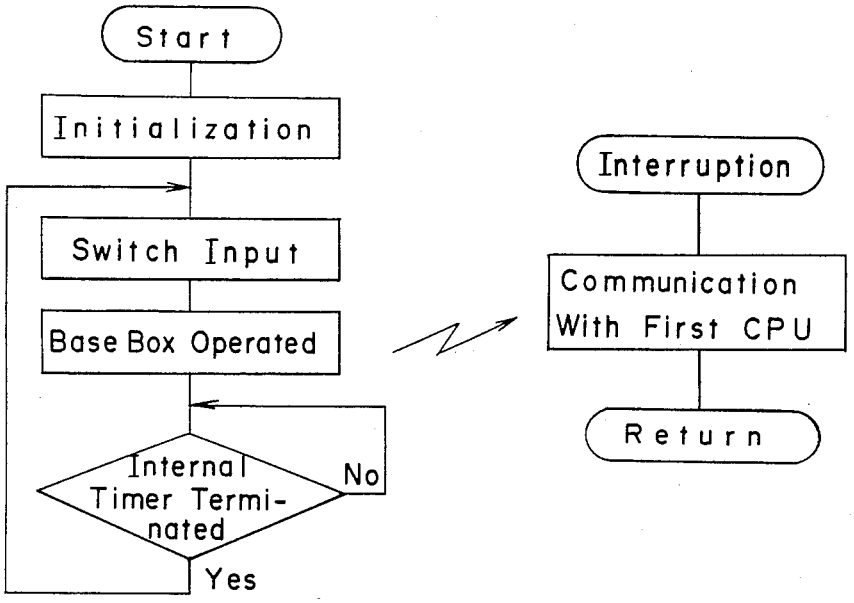
FIG. 19 is a flow chart showing a process performed by a third central processing unit.
Figure 20:
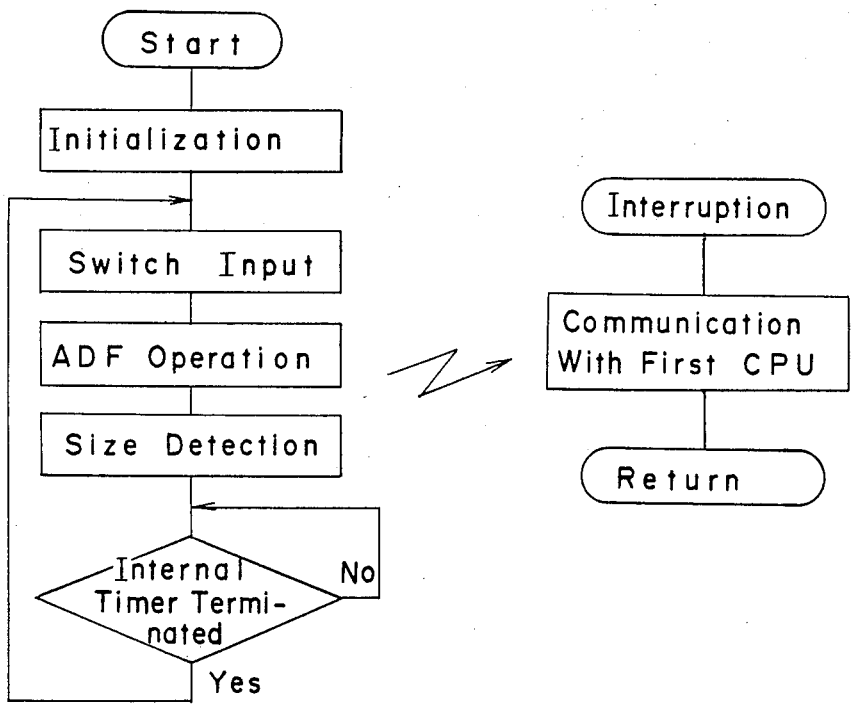
FIG. 20 is a flow chart showing a process performed by a fourth central processing unit.

FIGS. 8 to 18 illustrate flow charts showing the sequence of control of the magnification setting and the copying operation both executed in the first CPU. FIG. 19 is a flow chart showing the sequence of control of the paper supply unit performed by the third CPU, and FIG. 20 is a flow chart showing the sequence of control of the ADF unit performed by the fourth CPU. Although not shown in FIG. 20, the ADF unit detects the width of the original supplied by means of the sensors SE and the length thereof by counting the time required to pass across the sensors SE, and sends data of the width and length to the first CPU through the fourth CPU.

Figure 8:
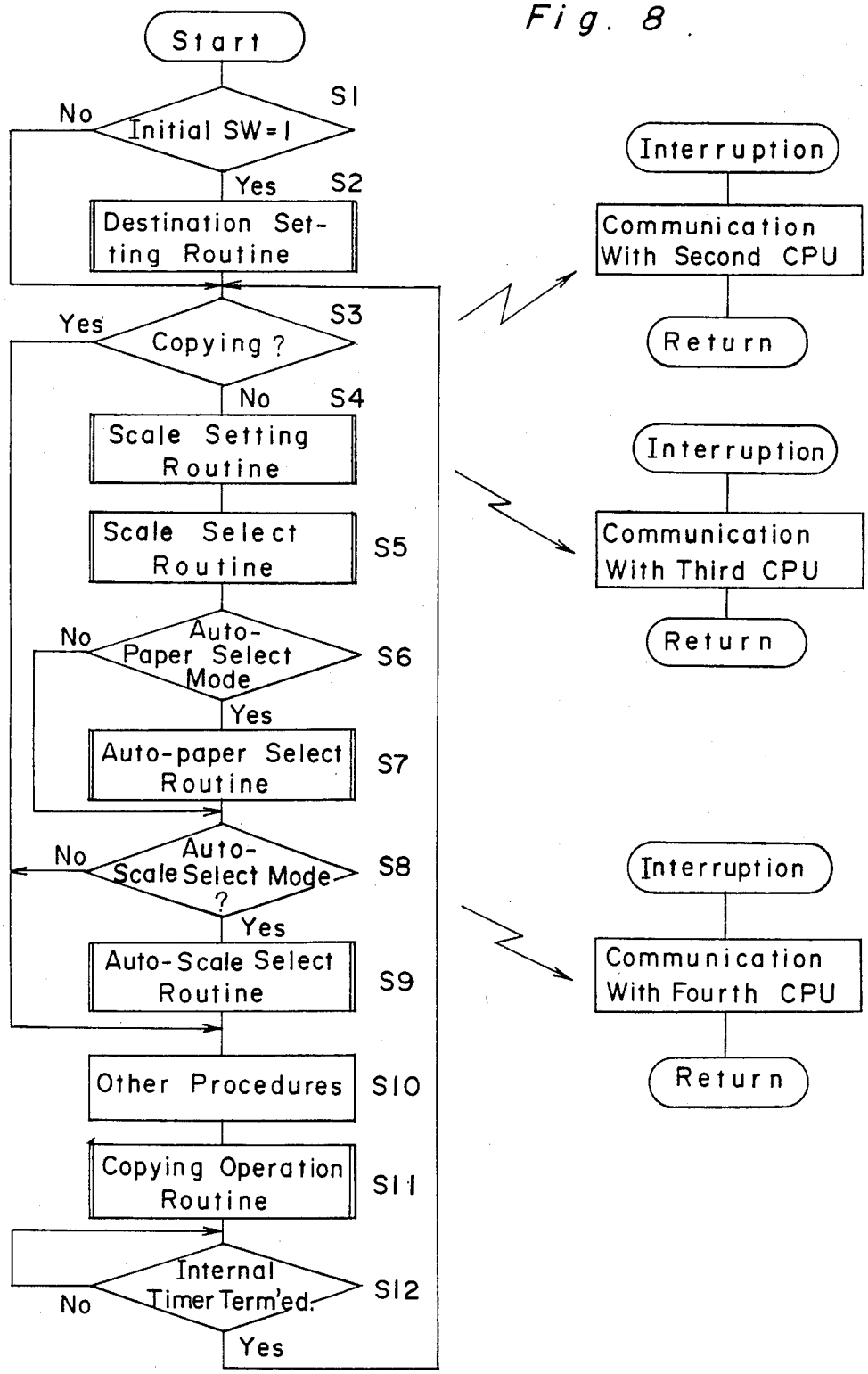
FIG. 8 is a flow chart showing the sequence of operation of an essential portion of the present invention.

FIG. 8 illustrates the flow chart schematically and generally showing the sequence of control in the first CPU.

The first CPU 201 communicates with any one of the second to fourth CPUs 202, 210 and 211 by way of the interruption procedure. Information such as a scan command concerned with the optical system, a scan size, a copying magnification, a timing signal, a return signal, and a home position signal is transmitted between the first and second CPUs 201 and 202. Between the first and third CPUs 201 and 210, information such as paper codes concerned respectively with the C and D paper supply units and a paper supply command concerned with the paper supply device is transmitted. And, between the first and fourth CPUs 201 and 211, an ADF start command, an auto-paper select release command, an auto-scale select release command, an original size code, an auto-paper select command, an auto-original select command, and an original setting signal are transmitted.

Figure 9:
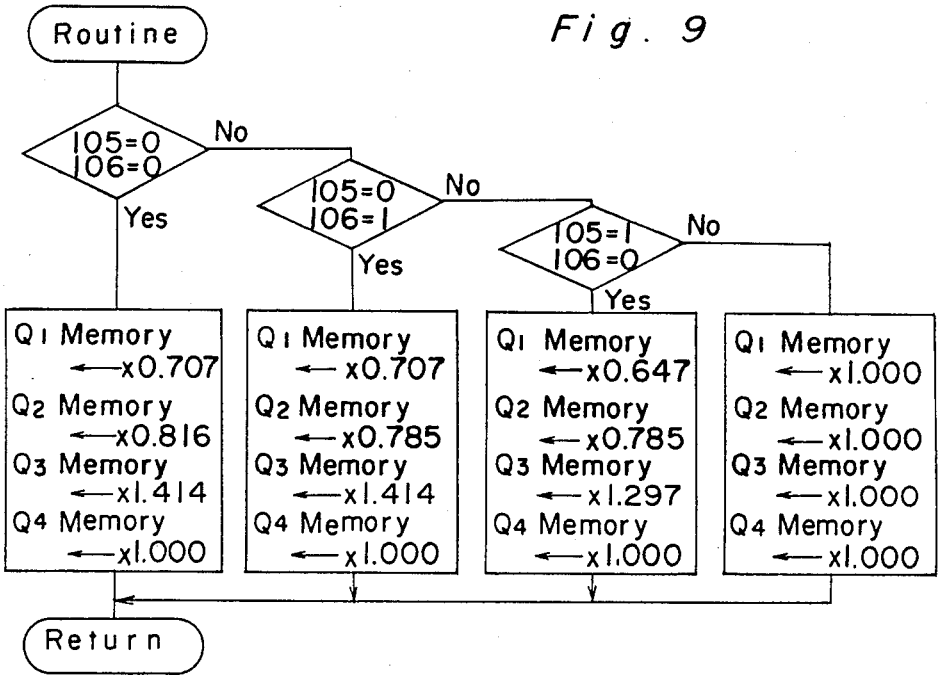
FIG. 9 is a flow chart showing a setting program for a particular magnification.

At the two successive steps S1 and S2, the process associated with the presetting of the magnification ratios in memories Q1 to Q4 which is mainly carried out during the assembly of the machine or at the time of shipment of the machine from the factory is executed. The details of this process are shown in FIG. 9.

Figure 12:
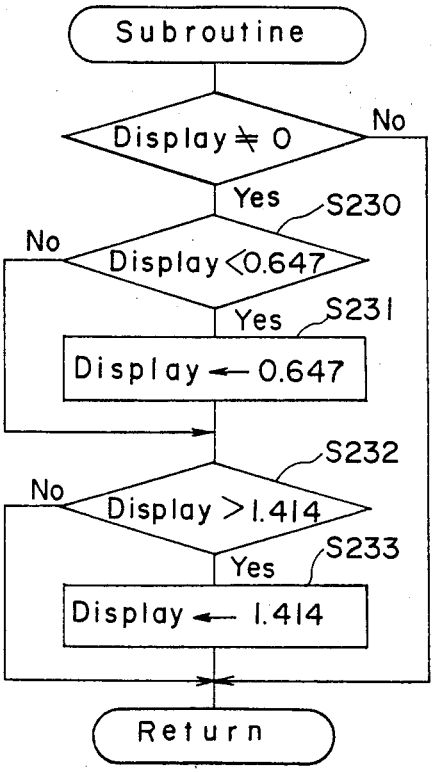
FIG. 12 is a flow chart showing the details of a subroutine in the setting program of FIG. 11.
Figure 10A:
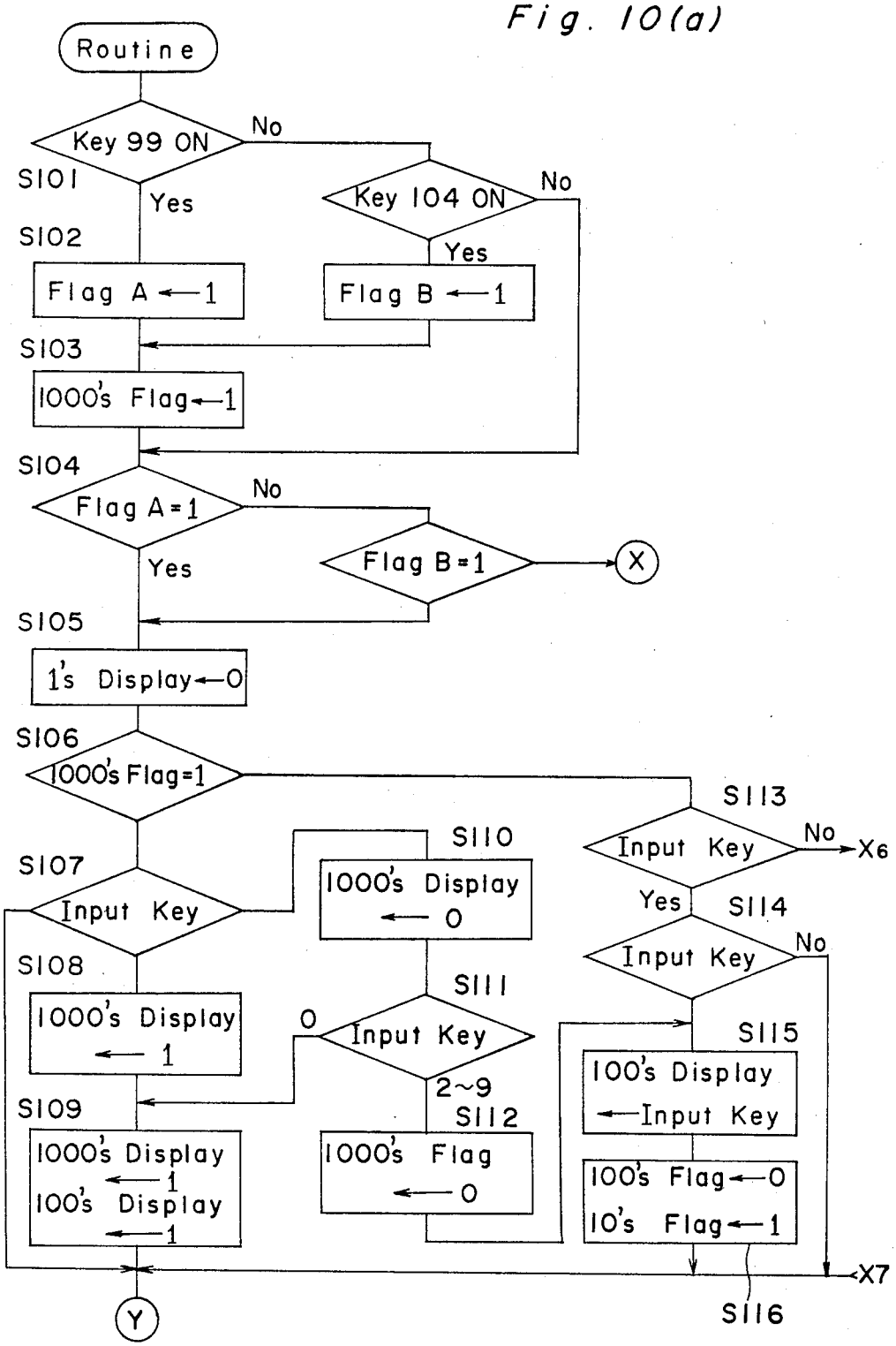
FIG. 10, comprised of FIGS. 10(*a*) and 10(*b*), is a flow chart showing one method for displaying the selected magnification ratio.
Figure 10B:
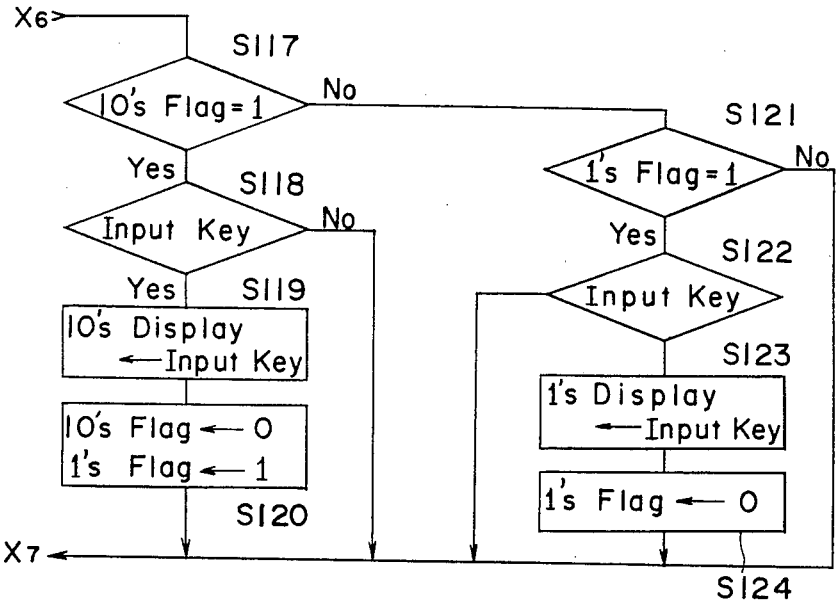
Figure 11A:
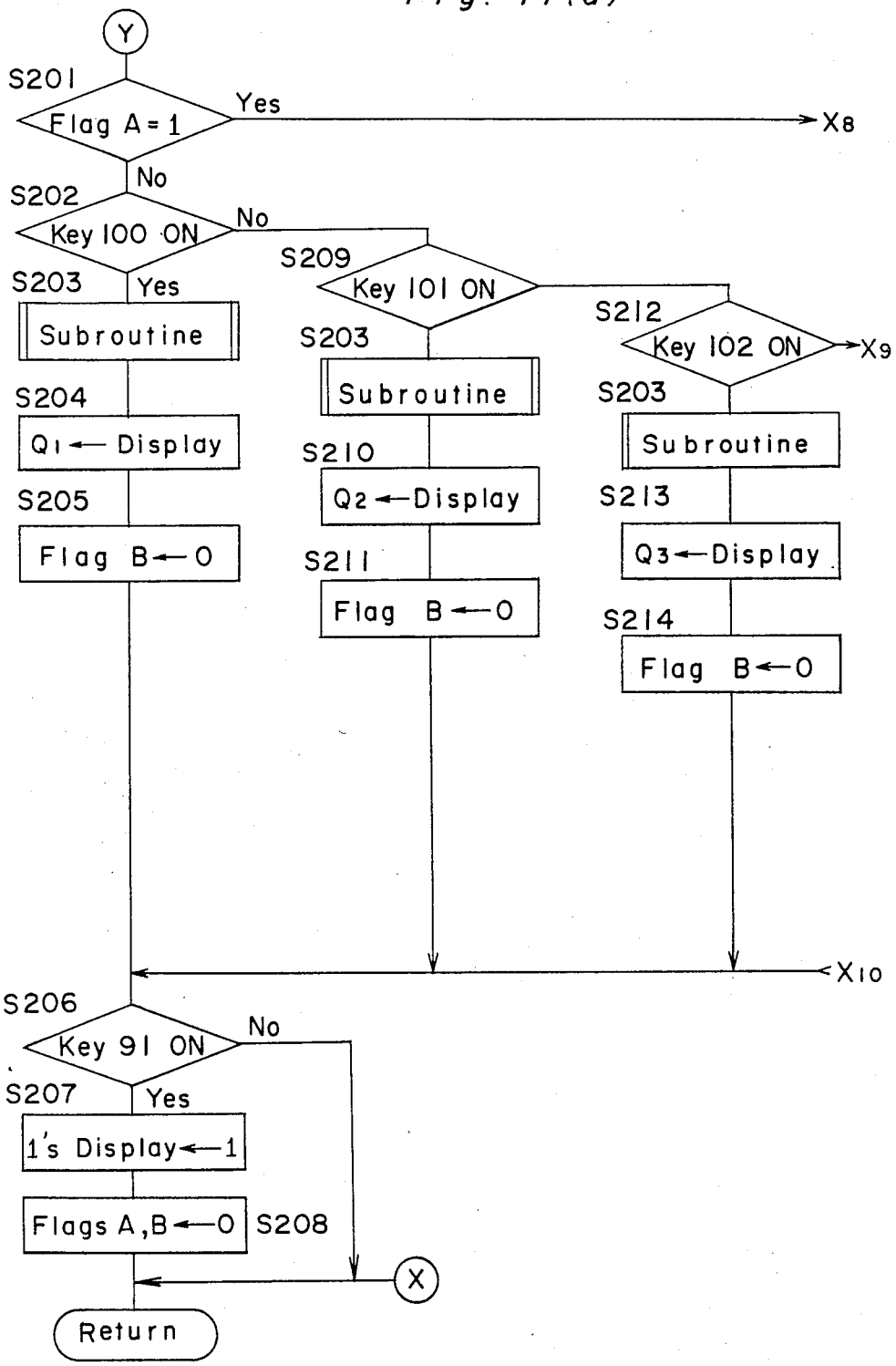
FIG. 11, comprised of FIGS. 11(*a*) and 11(*b*), is a flow chart showing the detail of the setting program.
Figure 11B:
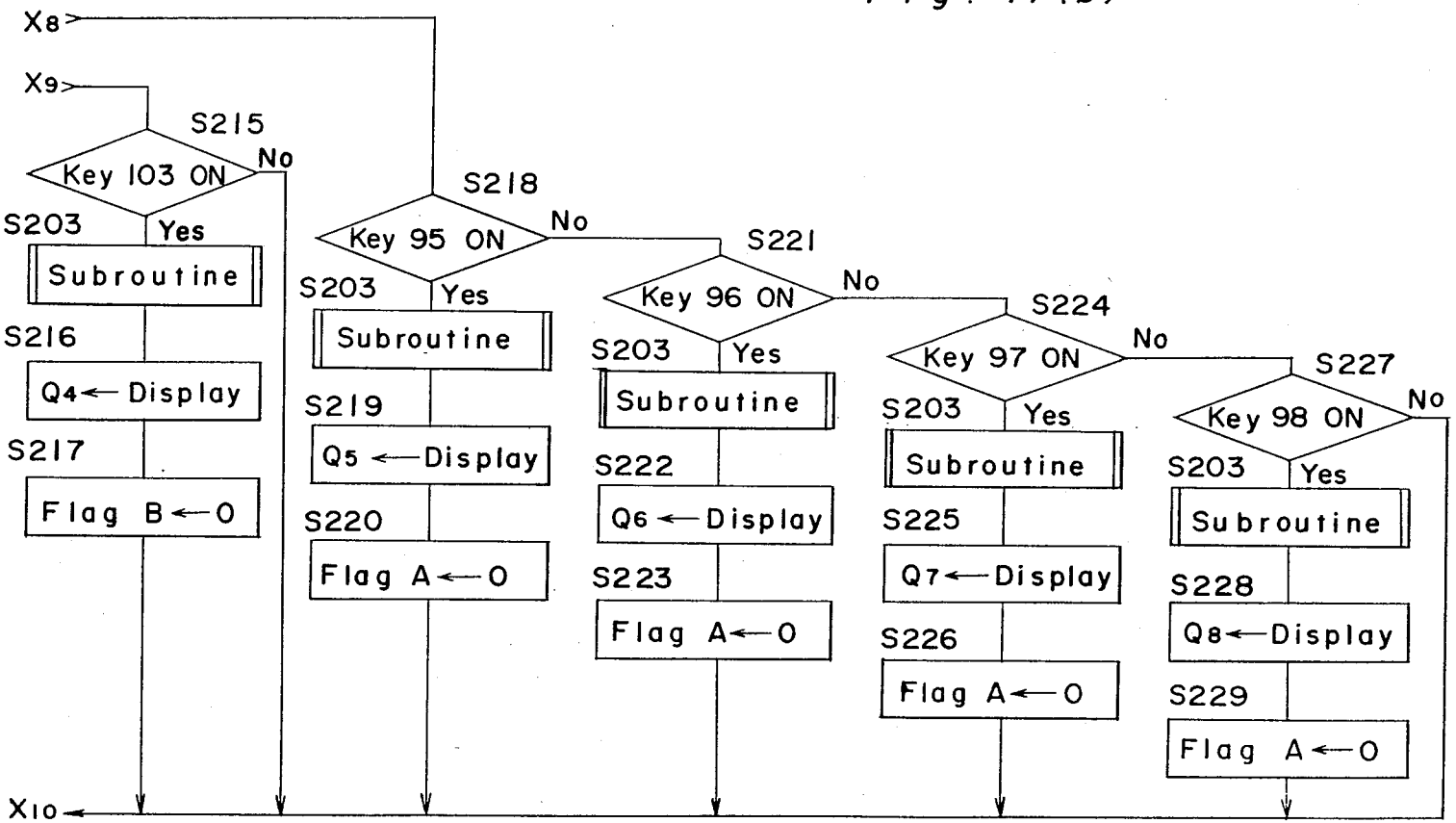

At the two successive steps S3 and S4, when the machine is not in copying operation, the process necessary to set the magnification ratios or scales Q5 to Q8 or Q1 to Q4 in association with the selector keys 95 to 98 or 100 to 103 is executed, the details of which are shown in FIGS. 10 to 12.

Figure 13:
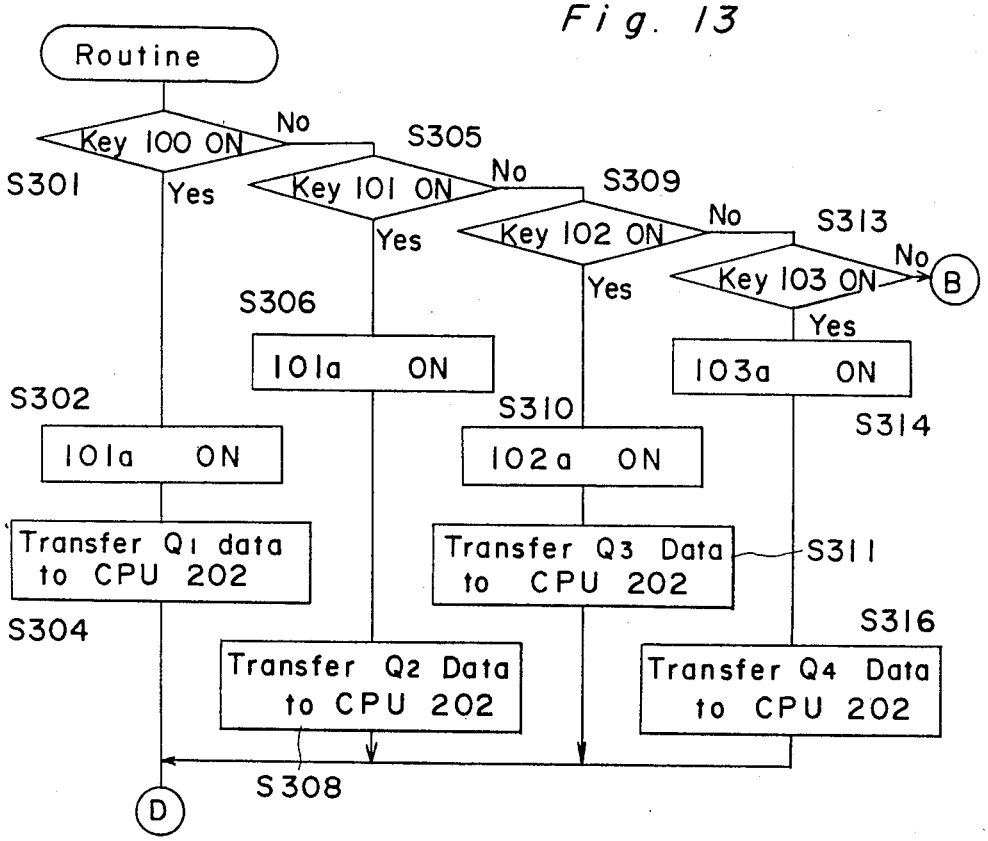
FIG. 13 is a flow chart showing a program for reading out the particular magnification.
Figure 14:
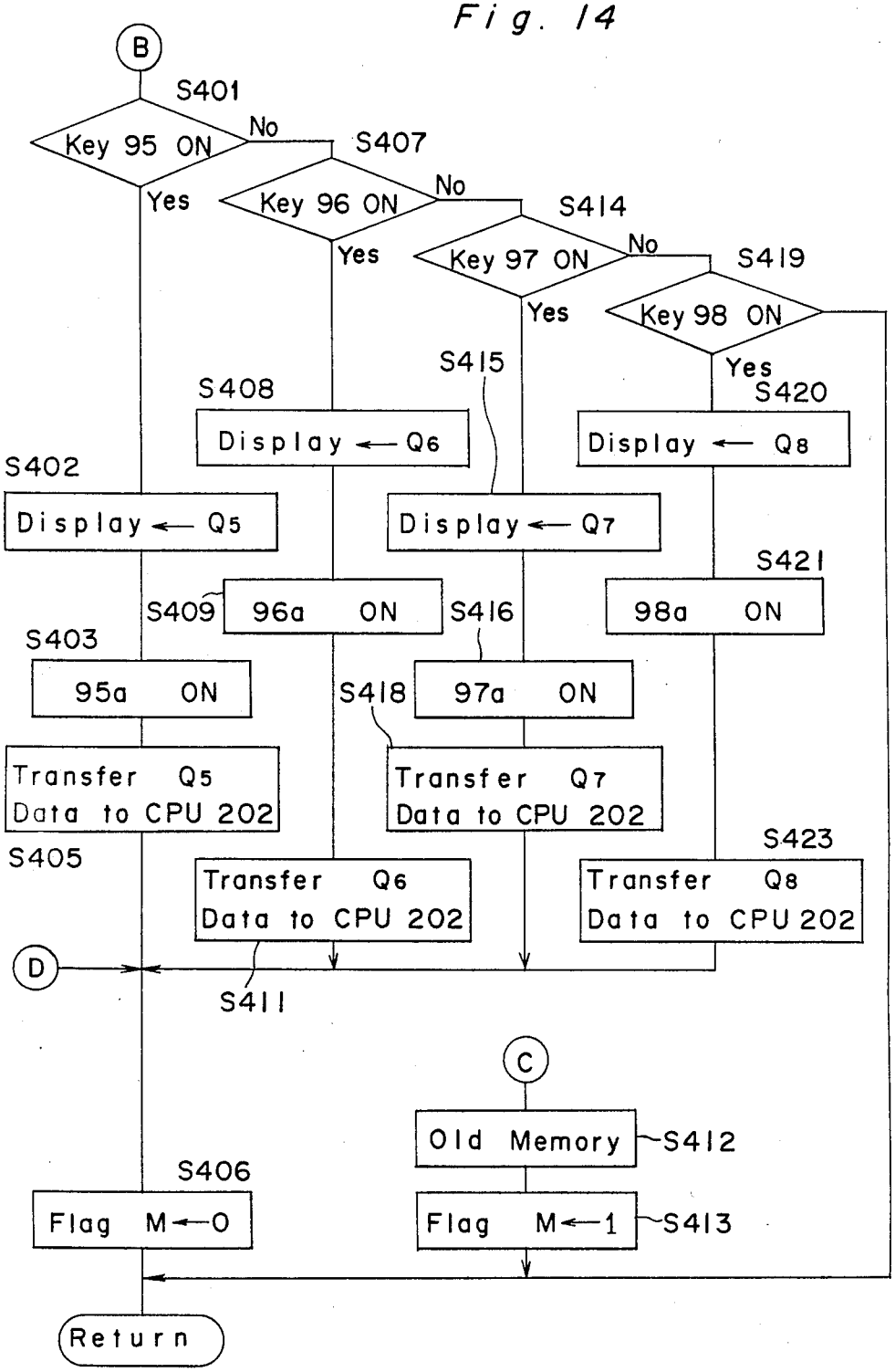
FIG. 14 is a flow chart showing a program for reading out an arbitrary magnification.

At step S5, a process necessary to transfer data for controlling the position of the lens assembly and the speed of drive of the motor to the second CPU 202 according to the scale set during step S4 is executed. During the data transfer, the second CPU 202 performs this process through the step of the interruption procedure. The details of step S5 are shown in FIGS. 13 and 14.

Figure 15:
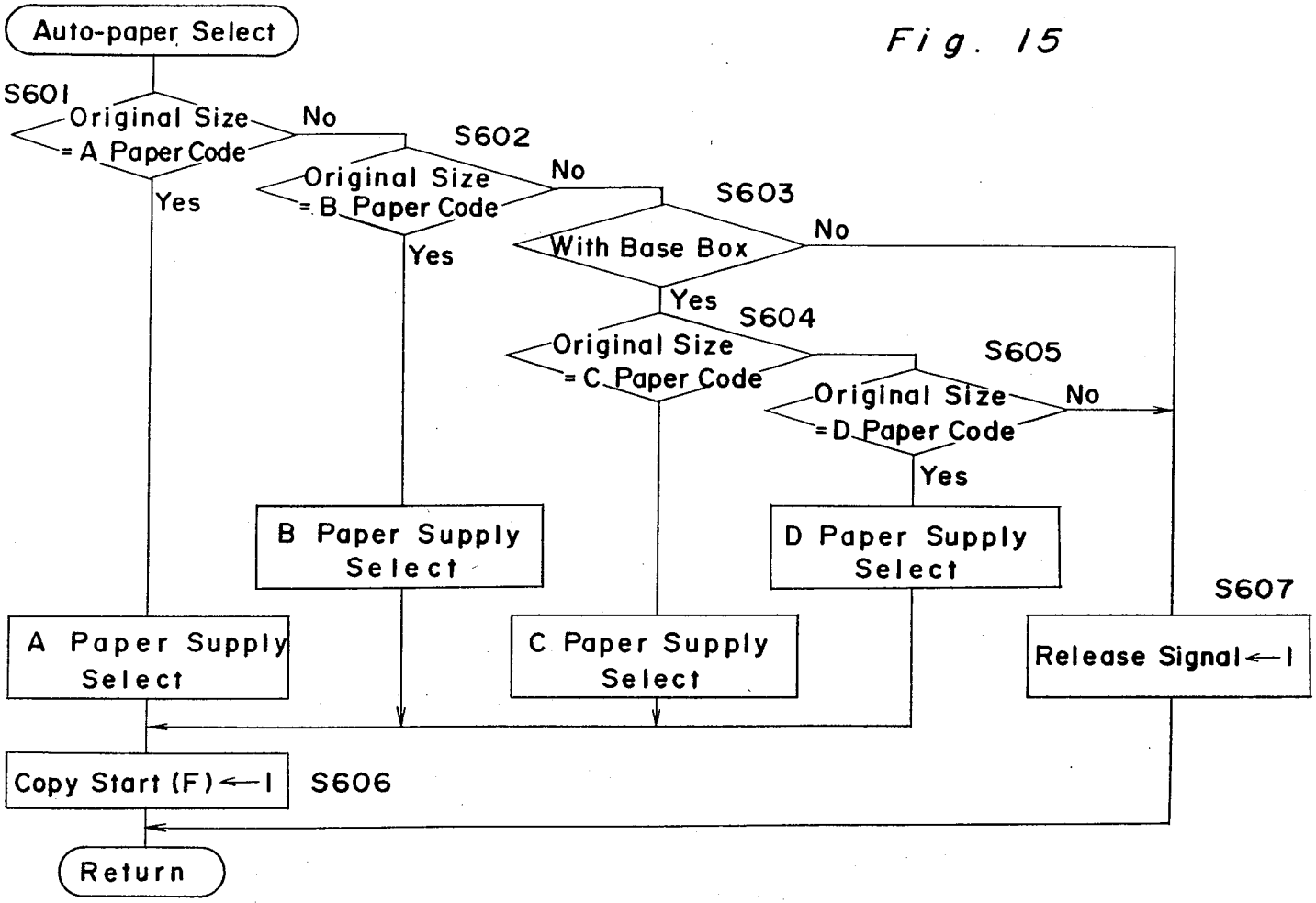
FIG. 15 is a flow chart showing a program for automatically selecting copying papers.
Figure 16:
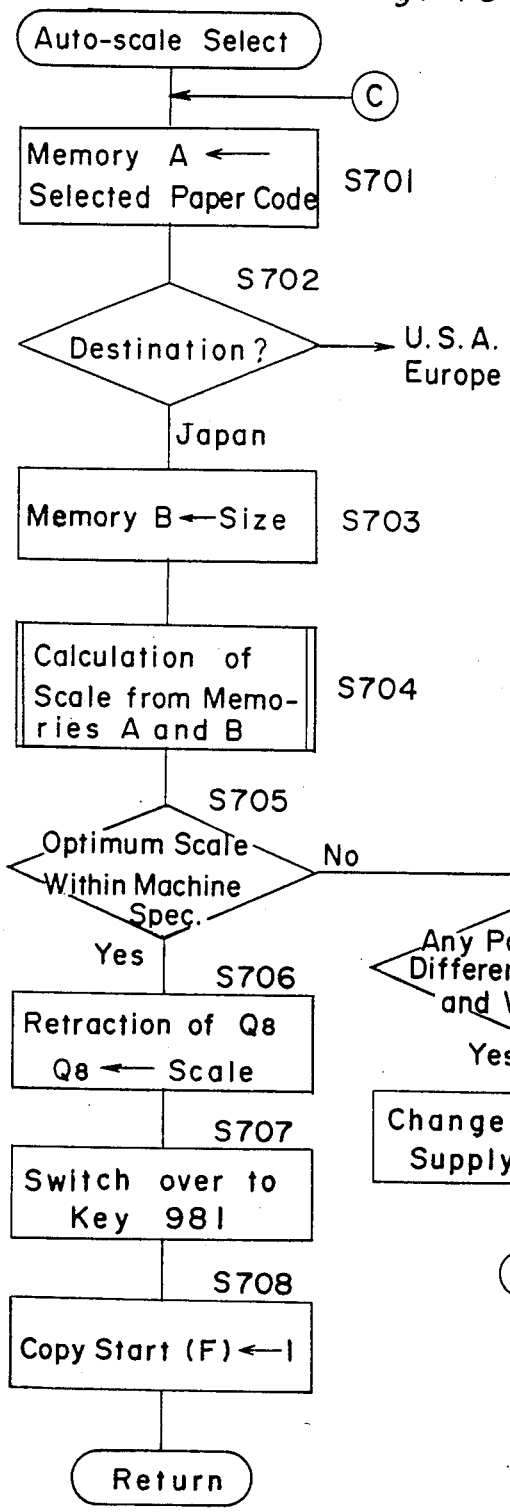
FIG. 16 is a flow chart showing a program for automatically selecting a magnification.
Figure 17:
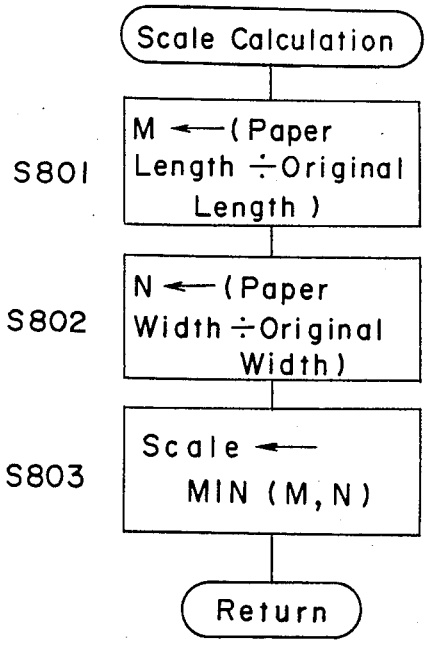
FIG. 17 is a flow chart showing a subroutine for the calculation of the magnification in the program of FIG. 16.

At steps S6 and S7, a process to be performed during an auto-paper select mode is executed and the details thereof are shown in FIG. 15. At steps S8 and S9, a process to be performed during an auto-scale select mode is executed and the details thereof are shown in FIGS. 16 and 17.

At step S10, other processes, for example, control of the temperature of a heater in the copying machine, and determination of the size of the copying papers, are executed.

Figure 18A:
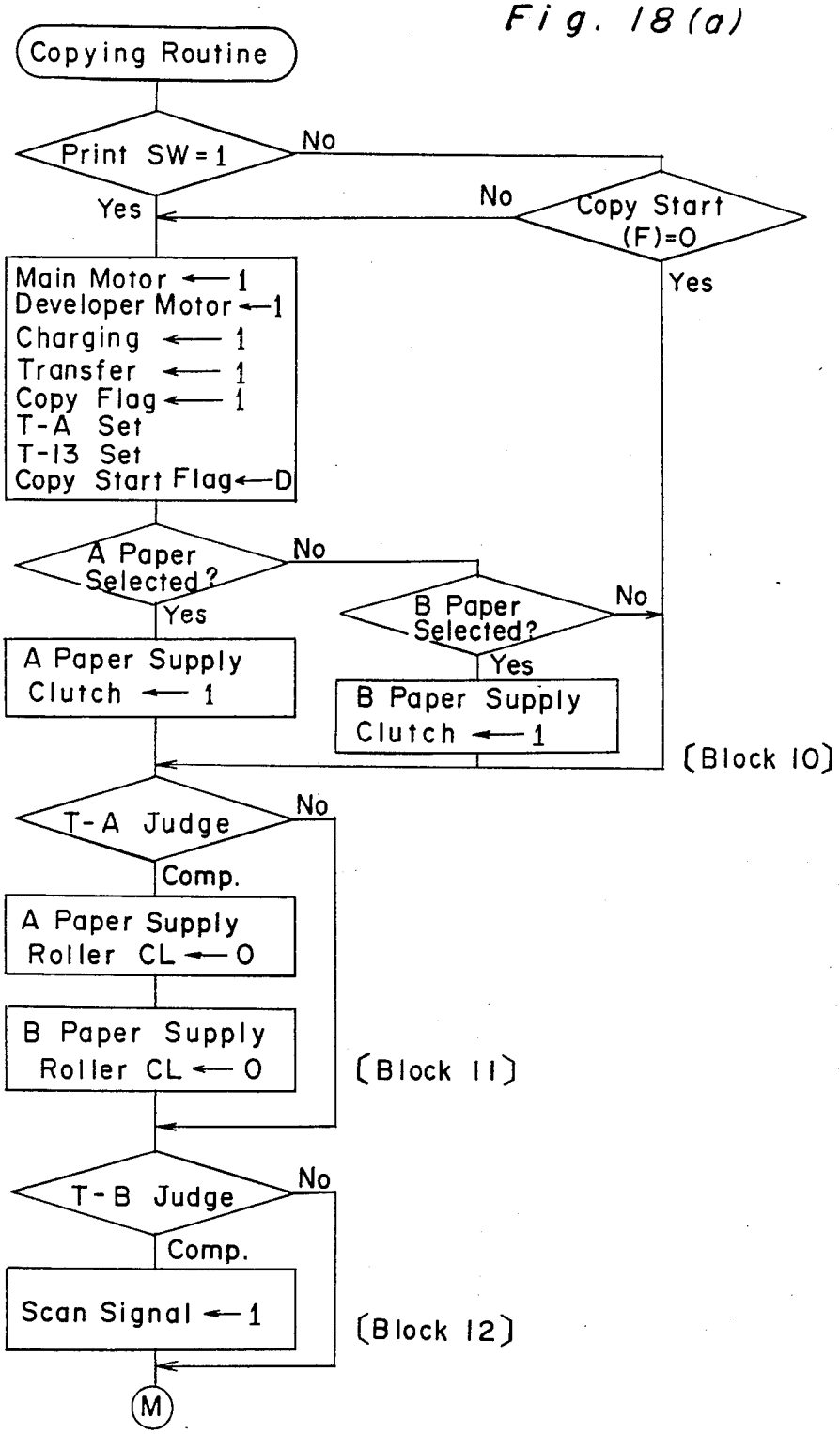
FIG. 18, comprised of FIGS. 18(*a*) and 18(*b*), is a flow chart showing the sequence of the copying operation performed by the machine.
Figure 18B:
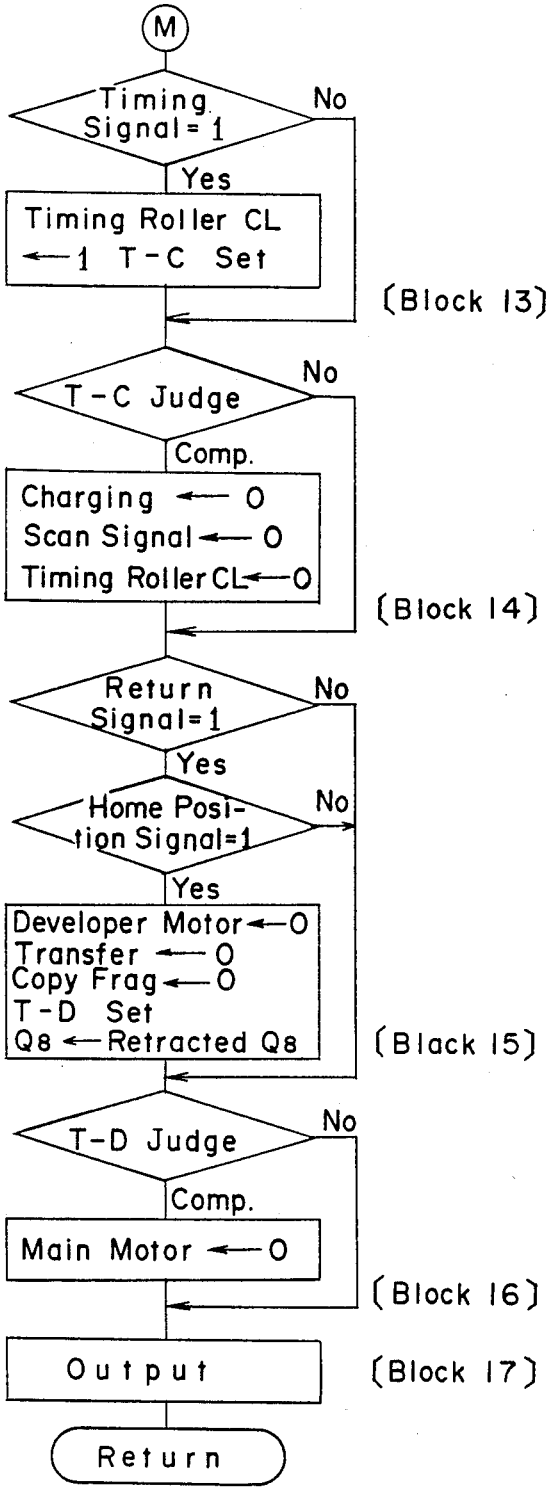
Figure 21:
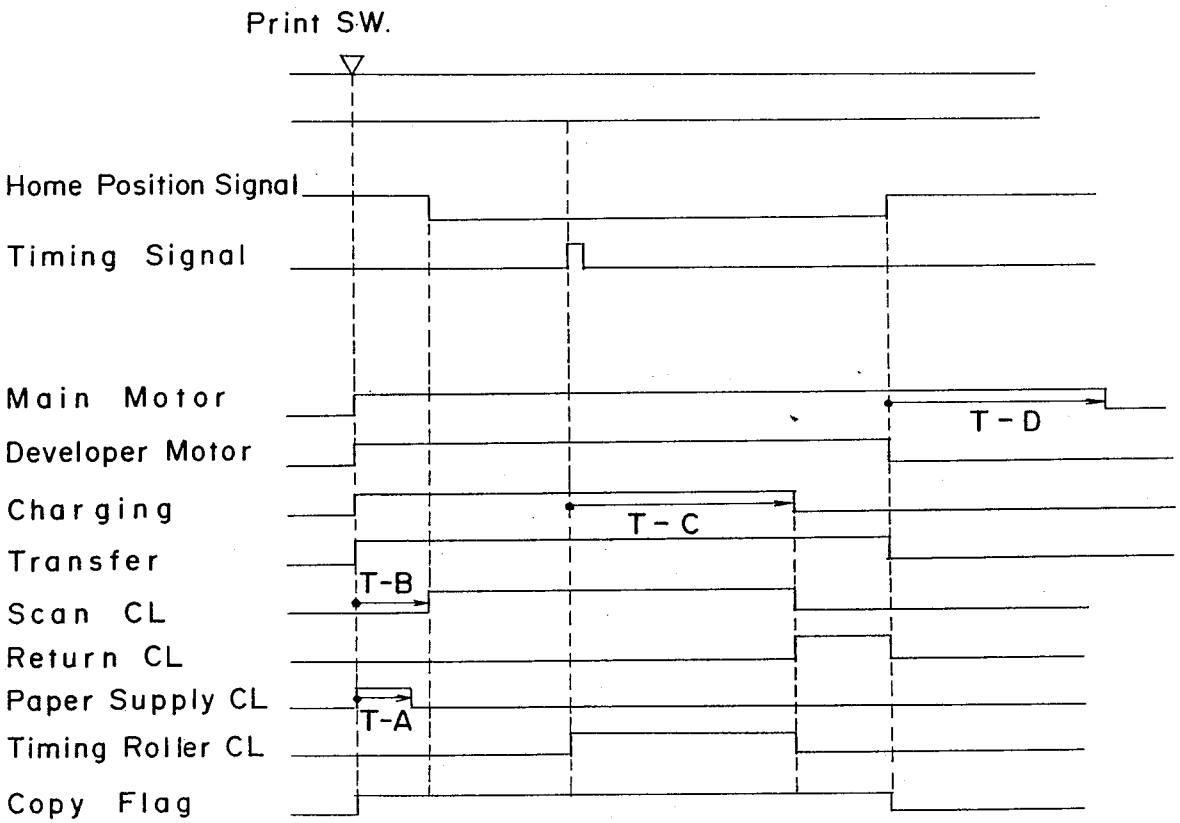
FIG. 21 is a chart of various waveforms showing an essential portion of the copying operation shown in FIG. 18.

At step S11, a process for the control of the copying operation is executed, the details of which are shown in FIG. 18. A time chart showing the operation thereof is shown in FIG. 21.

Referring to FIG. 9, there is shown the details of the initial setting procedure for presetting predetermined values in memories Q1 to Q4 corresponding to the second group of magnification setting keys 100 to 103. An initial switch referred to in step S1 in FIG. 8 is a switch of a type which can be accessible only to a servicing worker or during the assembly at a factory and which is installed at a location normally inaccessible to those except for authorized persons, and only when and after this initial switch has been operated, the routine shown in FIG. 9 can be executed.

The numerical values to be preset in memories Q1 to Q4 are determined in terms of the on and off states of switches shown by 105 and 106 in FIG. 1. More specifically, these numerical values can be preset in memories Q1 to Q4 by switching the switches 105 and 106 on and/or off according to a predetermined combination allocated for each particular destination to which the machine is to be shipped during the assembly of the machine or at the time of the shipment and then closing the initial switch. At steps S501 and S502, the setting of the magnification ratio in memories Q1 to Q4 according to a combination of the switching states of the switches 105 and 106 stored in the first CPU 201 is performed, and examples of the preset values according to a particular combination of the switching states of the switches 105 and 106 are tabulated in Table 2 below.

TABLE 2

| Switches | | Magnification Ratio | | | |
|---|---|---|---|---|---|
| 105 | 106 | Q1 | Q2 | Q3 | Q4 |
| 0 | 0 | 0.707 | 0.816 | 1.414 | 1.000 |
| 0 | 1 | 0.707 | 0.785 | 1.414 | 1.000 |
| 1 | 0 | 0.647 | 0.785 | 1.297 | 1.000 |
| 1 | 1 | 1.000 | 1.000 | 1.000 | 1.000 |

In the event that numerical values representative of the magnification ratio are to be set in memories Q1 to Q8 in correspondence with selector keys 100 to 103 and 95 to 98, the routines shown in FIGS. 10 to 12 are executed.

Referring to FIG. 10, in the event that the scale setting mode is established as a result of the manipulation of key 99 or 104, a decision is made at steps S101 and S102 to determine to what group of the keys the scale setting has been required. If key 99 has been manipulated, it is a first scale setting mode and, therefore, a flag A is set to be "1". On the other hand, if key 104 has been manipulated, a flag B representing a second scale setting mode is set to be "1".

Thus, when key 99 or 104 has been manipulated, a flag representing the 1000's place is rendered "1" at step S103 and the display of the 1's place is rendered "0" at step S105. That is, when the control of the copying machine is switched over to the scale setting mode, the digital display device 72 displays "bbb0" (b being indicative of a blank display) and is rendered ready to receive an input indicative of a numerical value to be placed in the 1000's place.

When any one of the numerical input keys is depressed during this condition, the type of key is determined at step S107 and, only when the "1" key 80 has been depressed, the process proceeds to step S108 at which "1" is displayed at the 1000's place. It is to be noted that, while reference is herein made to numerical values inputed in the form of digits at the 1000's, 100's, 10's and 1's places for the sake of brevity because of the digital display device 72, the numerical value representative of each magnification ratio is treated as a decimal figure of four effective digits down to three places of decimals.

Where the 1000's flag is "1" and the numerical value inputed is "0" or one of "2" to "9", the process proceeds to step S110 to make "0" displayed at the 1000's place. Subsequently, where the input is "0", the process proceeds to step S109 as is the case with the input of "1" to make the 1000's flag to be "0" and the 100's flag to be "1", thereby to wait for the input to the 100's place. In the case where the input is one of "2" to "9", the 1000's flag is rendered "0" at step S112, followed by step S115 at which the numerical value inputed is displayed at the 100's place.

The process described as occurring when the 1000's flag is "1" is based on the assumption that numerical values within the range of 0.647 to 1.414, representing the magnification ratios are treated as effective figures, and therefore, only either "0" or "1" can be displayable at the 1000's place. This arrangement is advantageous in that the procedure necessary to enter "0" at the 1000's place can be simplified. However, it may happen that, even though this procedure is carried out, a figure outside the available range of the magnification ratios will show up depending on the value to be inputed at the 100's place or the lower places. The process to be taken in such a case will be described later with reference to the subroutines shown in FIGS. 11 and 12.

When a numerical value is inputed to the 1000's place, the 100's flag is rendered "1", and when one of the numerical input keys is manipulated during this condition, a numerical value corresponding to the key manipulated for the 100's place can be inputed, the numerical value being displayed at step S115. At subsequent step S116, a procedure is executed to render the 100's flag to be "0" and the 10's flag to be "1". In a similar way, the input to the 10th place and then to the 1's place is performed by manipulating the numerical input keys.

The flow chart shown in FIG. 11 comprised of FIGS. 11(*a*) and 11(*b*) illustrates the procedure for storing the numerical value, inputed through the procedure of FIG. 10 and displayed, in the memory corresponding to the subsequently manipulated selector key.

At step S201, whether the machine is in a first scale setting mode or a second scale setting mode is determined. Since step S201 is executed only when either of the flags A and B is "1", step S201 is such as to determine whether, for example, flag A is "1" or not, and when it has been found that flag A is "1" signifying the first scale setting mode, the process proceeds to step S218 et seq. wherein the manipulation of any one of the first group of keys 95 to 98 is discriminated. On the contrary thereto, when flag A is not "1", that is, when flag B is "1", it signifies the second scale setting mode and, therefore, the process proceeds to step S202 et seq. wherein the manipulation of any one of the second group of keys 100 to 103 is discriminated.

During the execution of the procedure shown in FIG. 11, the displayed numerical value is, at any scale setting mode, stored in the memory corresponding to the manipulated selector key. However, as hereinbefore described, it may happen that a numerical value not falling within the available range of the magnification ratio may be displayed at this stage. Accordingly, during the execution of the procedure shown in FIG. 11, a subroutine is executed at step S203 subsequent to each determination of the key manipulated, so as to avoid the possibility that the numerical value outside the available range of the magnification ratio may be stored in the memory. The details of step S203, that is, that of the subroutine, are best shown in FIG. 12.

Referring to FIG. 12, if the display is not "0", decision step S230 is carried out to determine whether or not the displayed numerical value is smaller than 0.647, and if it is smaller than 0.647, "0.647" is displayed at step S231. At step S232, a decision is carried out to determine whether or not the displayed numerical value is greater than 1.414, and if it is greater than 1.414, "1.414" is displayed at step S233.

Accordingly, referring still to FIG. 11, when the predetermined selector key is manipulated during the scale setting mode, and if the displayed numerical value is outside the available range of the magnification ratios, the displayed numerical value is stored in the memory corresponding to such key after the display is rendered to be an allowable limit value. When the process is carried out to store the numerical value in the memory, flag A in the case of the first scale setting mode or flag B in the case of the second scale setting mode is rendered to be "0" and then the process proceeds to step S206.

The process from step S206 to step S208 is the one which is carried out when clear/stop key 91 (FIG. 5) has been manipulated. When clear/stop key 91 has been depressed, "bbb1" is displayed in display device 72 at step S207, and then flags A and B are rendered "0" at step S208. In other words, when clear/stop key 91 has been manipulated, the numerical value displayed in cleared and, at the same time, the scale setting mode is released. Accordingly, the numerical figure "1" displayed thereby signifies the number of copies to be reproduced in terms of a standard preset number "1".

The process to be executed when the first and second groups of selector keys 95 to 98 and 100 to 103 are manipulated is shown in FIGS. 13 and 14.

Referring to FIG. 13, when one of the keys 100, 101, 102 and 103 is manipulated, one of the light emitting diodes 100*a*, 101*a*, 102*a* and 103*a* (FIG. 5) one for each of these keys, which is associated with such one of the keys 100 to 103 is lit and, subsequently, a numerical value stored in the memory is transferred to the second CPU 202 as a scale data, followed by step S406 shown in FIG. 14.

Referring now to FIG. 14, when one of the selectors keys 95 to 98 is manipulated, a light emitting diode corresponding thereto is similarly lit and, since it signifies an arbitrary scale setting, the numerical values set in the corresponding memories Q5 to Q8 are displayed in display device 72 at steps S402, S408, S415 and S420. This display continues, for example, so long as the respective key is being depressed, and when the key is released, the number of copies to be made, which is set in the other storage device is recalled and displayed in the display device 72. The numerical value stored in the memory is transferred to the second CPU 202 as a scale data.

The foregoing is a description concerning the setting procedure to be done in the scale setting device. As is clear from the foregoing, according to this scale setting device, an arbitrary copying magnification ratio, or an arbitrary copying scale, required for each user of the copying machine can readily be set by the utilization of the first scale setting mode, and should the necessity arise, the arbitrary copying scale once set can be reconfirmed by causing it to be displayed in the display device, while that numerical value can also be used as a control data for the copying machine. In addition, according to the second scale setting mode, the adjustment of the scale by reading an error between the copying scale, represented by the numerical value, and the scale of the image actually reproduced at a predetermined magnification can readily be carried out with no substantial difficulty.

With respect to the numerical value thus set, lens assembly 14 is moved and controlled by a control unit 206 on the basis of an output from the second CPU 202 to establish the copying scale represented by such numerical value. Stepping motor M4 used for driving the lens assembly 14 at that time can be drivingly controlled so as to rotate in either one of the opposite directions a single pitch per a numerical value "0.001" or "0.002". Accordingly, in practice, a substantially indefinite magnification adjustment can be accomplished. In addition, the speed of movement of the optical system is also controlled by a control unit 205 on the basis of an output from the second CPU 202 so as to be variable in correspondence with the numerical value set, and so far as the speed control of the DC motor, which is a source of drive therefor, is concerned, numerous systems have hitherto been suggested and/or proposed and, therefore, the details thereof are not herein described.

Referring back to FIG. 5, a panel portion 70*a* adjacent the first group of selector keys 95 to 98 is comprised of a panel or a white board removably fitted either magnetically or by the use of an adhesive tag, so that the user of the machine can eraseably write any information such as the arbitrarily selected magnification ratio or such a legend as "Memo size→A4" on the panel. This panel portion 70*a* may be either protruded or recessed in relation to the other panel portion.

Referring to FIG. 15, there is shown a subroutine for the auto-paper select mode. At steps S601 and S602, the size of the original transported by means of the ADF unit is compared with the sizes of the cassettes in the respective A and B paper supply units and, if the base box is utilized in association with the copying machine, it is also compared at steps S604 and S605 with the sizes of the cassettes in the respective C and D paper supply units. If the original size is found equal to the cassette size as a result of each of these comparisons, the relevant paper supply unit is selected, followed by step S606 at which a copy start mode is established. Should the result of the comparison show that the original size is not equal to any cassette size, step S607 is carried out to send an auto-paper select mode release signal.

FIG. 16 illustrates a subroutine for the autoscale select mode. At step S701, the paper code (shown in Table 1) of the selected paper supply unit is placed in memory A. At subsequent step S702, a decision making is performed to determine the destination to which the copying machine is shipped. This is because the size of papers in Japan, the U.S.A., and European countries differs from country to country in the light of A-type, B-type and inches and, therefore, the available range of the magnification ratios varies from country to country. For the purpose of the description of the present invention, the machine is assumed to have been designed for use in Japan while reference to the U.S.A. and European countries will not be made. After the decision making at step S702, data of the size of the original fed by means of the ADF unit are placed in memory B at step S703.

At succeeding step S704, based on the data from memories A and B, the lengthwise scale and the widthwise scale are individually calculated, and the smallest one of the lengthwise and widthwise scales which have been calculated is treated as the optimum copying scale. The details of step S704 are shown in FIG. 17.

At subsequent step S705, a decision making is performed to determine whether or not the optimum copying scale satisfies the specification of the machine. In other words, if the machine is of a type capable of reproducing an image at a magnification ratio within the range of $\times 0.707$ to $\times 1.414$ because of the machine designed for use in Japan, no copying at $\times 0.6$ magnification is available. Thus, if the optimum copying scale satisfies the machine specification, scale Q8 is retracted to the other memory at step S706 and the optimum copying scale is placed in memory Q8 corresponding to the arbitrary scale setting key 98. Then at step S707, switching takes place over to a 98 key selecting mode, followed by step S708 at which the copy start mode is established.

On the other hand, if the result of the decision at step S705 shows that the optimum copying scale does not satisfy the machine specification, step S705 is followed by step S709 at which search is made to find if there is any paper having different longitudinal and latitudinal even though the size remains the same. If the result shows that there is such a paper of different length and width, the paper supply unit is changed at step S710 and the foregoing flow is repeated. However, when the result of the search at step S709 shows that there is no paper of different length and width, step S711 is initiated to release the auto-scale select mode.

Accordingly, in such case, key 98 and the memory corresponding thereto must be open for the scale setting during the auto-scale select mode. Alternatively, if key 98 and the corresponding memory are set with some numerical values, they can be forcibly replaced during the execution of the auto-scale select mode. It may also be possible to temporarily retract memory Q corresponding to key 98 to the other memory and then to retrieve the numerical value, which has been retracted, to memory Q corresponding to key 98 at the time of completion of the copying operation.

Step S704 is executed in the manner as shown by the flow chart of FIG. 17. Referring to FIG. 17, at step S801, the length of the paper is divided by the length of the original to produce the lengthwise scale M, and at step S802, the width of the paper is divided by the width of the original to produce the widthwise scale N. At step S803, the smallest one of these scales M and N is dealt as the optimum copying scale.

Copying Operation

FIG. 18, comprised of FIGS. 18(*a*) and 18(*b*), illustrates a flow chart showing the sequence of control of the copying operation of the copying machine. The flow chart will now be described, referring also to FIG. 21 showing a time chart.

In block 10, when print switch SW is depressed, or if the copy sheet flag is "1", a main motor, the developer motor, the charging unit and the transfer unit are rendered on and, if the A or B paper supply is selected, an A or B paper supply roller clutch, respectively is rendered on. Thereafter, the copy flag is rendered "1" and, then T-A (timer-A) and T-B (timer B) are set. In subsequent block 11, T-A is judged, and if it is the timing at which T-A is terminated, the A and B paper supply roller clutches are turned off. In block 12, T-B is judged, and if it is the timing at which T-B is terminated, the scan signal is rendered on. In block 13, when the timing signal becomes "1", timing roller CL is turned on and a T-C is set.

In block 14, at the timing of termination of T-C, the charging unit, scan signal and timing roller Cl are turned off. In block 15, when a return signal is "1", that is, when a home position SW is turned on upon the return of a scanner that has once left the home position, the developer motor and the transfer unit are rendered off, a copy flag is rendered "0", and a T-D is set while the magnification ratio or scale Q8 which has been retracted at step S706 is retrieved. In block 16, at the timing of termination of T-D, the main motor is turned off. In subsequent block 17, the result of the process which has taken place is outputed.

Although in the illustrated embodiment the auto-scale select switch and its display unit as well as the auto-paper select switch and its display unit have been described as provided in the ADF unit, they may be arranged on the control panel of the copying machine. In addition, although the size of the original has been described as detected on the side of the ADF unit, it can be done on the side of the copying machine regardless of the provision of the ADF unit.

Even in the case where the originals of different size or orientation are set in the ADF unit in a stacked form, copies of the same size can be obtained from the machine provided that it be set in the auto-scale select mode. This is because, if set in the auto-scale select mode as hereinabove described, an appropriate magnification ratio or scale can automatically be set in the memory corresponding to key 98 each time a copy is made.

In the foregoing embodiment, during the auto-scale select mode according to the present invention, the accurate magnification or scale is determined by performing an arithmetic calculation to the size of the original and the size of the copying paper and is then set in memory Q8. However, depending on the user of the copying machine, he or she may not require such an accurate magnification. In such case, the magnification may be determined by following the procedure shown in FIG. 22.

Figure 22:
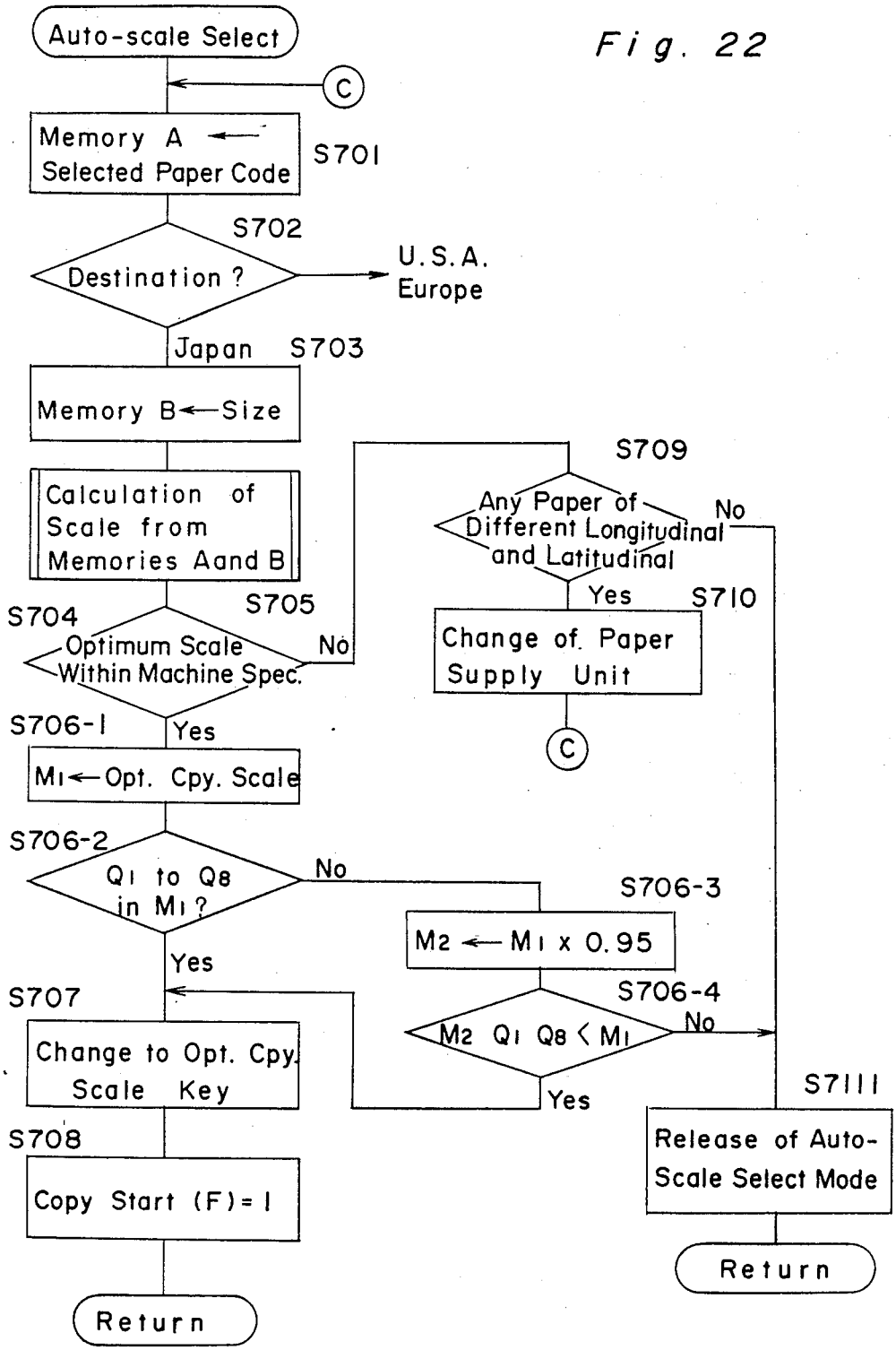
FIG. 22 is a flow chart similar to that of FIG. 16, showing a modification thereof.

Referring now to FIG. 22, at step S701, the paper code (shown in Table 1) of the selected paper supply unit is placed in memory A. At subsequent step S702, a decision making is performed to determine the destination to which the copying machine is shipped. This is because the size of papers in Japan, the U.S.A., and European countries differs from country to country in the light of A-type, B-type and inches and; therefore, the available range of the magnification ratios varies from country to country. For the purpose of the description of the present invention, the machine is assumed to have been designed for use in Japan while reference to the U.S.A. and European countries will not be made. After the decision making at step S702, data of the size of the original fed by means of the ADF unit are placed in memory B at step S703. At the succeeding step S704, based on the data from memories A and B, optimum copying magnification ratios or scales are searched as shown in Table 3.

TABLE 3

| | Sizes of Originals | | | | | | | | | |
|---|---|---|---|---|---|---|---|---|---|---|
| Papers | A-5L | B-5L | A-4L | B-4L | A-3L | (A-5W) | B-5W | A-4W | (B-4W) | (A-3W) |
| A-6Lo | x0.707 | x | x | x | x | x | x | x | x | x |
| B-6Lo | x0.865 | x0.706 | x | x | x | x | x | x | x | x |
| A-5Lo | x1.000 | x0.815 | x0.707 | x | x | ↓ | ↓ | ↓ | x | x |
| A-5La | ↑ | ↑ | ↑ | x | x | x1.000 | x0.815 | x0.707 | x | x |
| B-5Lo | x1.223 | x1.000 | x.0865 | x0.706 | x | ↓ | ↓ | ↓ | ↓ | x |
| B-5La | ↑ | ↑ | ↑ | ↑ | x | x1.223 | x1.000 | x0.865 | x0.706 | x |

TABLE 3-continued

| Papers | Sizes of Originals | | | | | | | | | |
|---|---|---|---|---|---|---|---|---|---|---|
| | A-5L | B-5L | A-4L | B-4L | A-3L | (A-5W) | B-5W | A-4W | (B-4W) | (A-3W) |
| A-4Lo | x1.414 | x1.153 | x1.000 | x0.815 | x0.707 | ↓ | ↓ | ↓ | ↓ | ↓ |
| A-4La | ↑ | ↑ | ↑ | ↑ | ↑ | x1.414 | x1.153 | x1.000 | x0.815 | x0.707 |
| B-4Lo | x1.414 | x1.412 | x1.223 | x1.000 | x0.865 | ↓ | ↓ | ↓ | ↓ | ↓ |
| B-4La | ↑ | ↑ | ↑ | ↑ | ↑ | x1.414 | x1.412 | x1.223 | x1.000 | x0.865 |
| A-3Lo | x1.414 | x1.414 | x1.414 | x1.153 | x1.000 | ↓ | ↓ | ↓ | ↓ | ↓ |
| A-3La | ↑ | ↑ | ↑ | ↑ | ↑ | x1.414 | x1.414 | x1.414 | x1.153 | x1.000 |

L: Length,
W: Width
↑: A combiation for the search of any paper of different longitudinal and latiutdinal
x: A combinatioin for the auto-scale mode release At subsequent step S705, a decision making is performed to determine whether or not the optimum copying scale satisfies the specification of the machine. In other words, if the machine is of a type capable of reproducing an image at a magnification ratio within the range of ×0.707 to ×1.414 because of the machine designed for use in Japan, no copying at ×0.6 magnification is available. Thus, if the optimum copying scale satisfies the machine specification, the optimum copying scale is placed in memory M1 at step S706-1, followed by step S706-2 at which a check is made to find one of the eight scale selector keys in which the optimum copying scale obtained from Table 3 is stored. If it is determined that not one of memories Q1 to Q8 store the scale placed in memory M1, an equation of M1×0.95 is calculated at step S706-3, the result of the calculation being subsequently placed in a memory M2. This is the standard in which the magnification which has resulted in the reduction of up to 5% without accompanying any defect in the reproduced image is deemed proper, and at subsequent step S706-4, the scale key approximating to the optimum copying scale between M2 and M1 is selected out of the eight copying scales, and at step S707, the control is shifted to such scale key. Then, at step S708, the copy start mode is established.

On the other hand, if the result of the decision at step S705 shows that the optimum copying scale does not satisfy the machine specification, step S705 is followed by step S709 at which a search is made to find if there is any paper having different longitudinal and latitudinal even though the size remains the same. If the result shows that there is such a paper of different longitudinal and latitudinal, the paper supply unit is changed at step S710 and the foregoing flow is repeated. However, when the result of the search at step S709 shows that there is no paper of different longitudinal and latitudinal, step S711 is initiated to release the auto-scale select mode.

Thus, by utilizing one of the preset copying scales Q1 to Q8, the copying can be executed.

As hereinbefore fully described, since the present invention is such that, in the copying machine capable of performing a copying operation at any one of arbitrary copying magnifications within a predetermined range, the copying magnification is calculated on the basis of the size of the original and that of the copying paper and, if the calculated magnification is a value within the predetermined range, the value is set as the copying magnification, an appropriate magnification can be automatically set in the case where copies are desired to be made from various originals while the copying papers are of the same size. Therefore, the user of the copying machine embodying the present invention need not always adjust the magnification each time a copy is made and, also, any possibility of a copy being made at an inaccurate magnification can be advantageously avoided.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

We claim:

1. A copying machine with a photoreceptor having a capability of reproducing an image at different magnifications one at a time, which machine comprises, in combination:

means for detecting the size of an original bearing an image to be reproduced on a copying paper;

means for discriminating the size of a copying paper to be used;

a storage means storing a numerical figure representative of a magnification ratio of the original image and composed of a predetermined number of digits;

a magnification control means for controlling at least the magnification ratio at which the image is projected onto the photoreceptor in dependence on the numerical figure stored in the storage means so as to enable a copying operation to be executed at a magnification corresponding to the numerical figure stored in the storage means;

a calculating means for calculating a magnification ratio from the size of the copying paper discriminated by said discriminating means; and a regulating means for causing a value, obtained by the calculation performed by said calculating means, to be stored in said storage means when said value is within a predetermined range of present values.

2. A machine as claimed in claim 1, further comprising a document feeder for supplying the original onto a predetermined position above the copying machine, and wherein said detecting means includes means for detecting the size of the original when said document feeder supplies the original onto the predetermined position.

3. A machine as claimed in claim 1, further, comprising a numerical input means for inputting a number through a predetermined manipulation, a second storage means for storing the number so input, and means for selecting said second storage means, the magnification ratio being determined on the basis of the number stored in the second storage means when said second storage means is selected by said selecting means.

4. A machine as claimed in claim 2, further comprising a numerical input means for inputting a number through a predetermined manipulation, a second storage means for storing the number so input, and means for selecting said second storage means, the magnification being determined on the basis of the number stored in the second storage means when said second storage means is selected by said selecting means.

5. A machine as claimed in claim 1, wherein the calculation performed by said calculating, means includes the calculation of a corresponding two separate sides of each of the original and the copying paper and the selection of a smaller value from the results of such calculation.

6. A machine as claimed in claim 2, wherein the calculation performed by said calculating means includes the calculation of a corresponding two separate sides of each of the original and the copying paper and the selection of a smaller value from the results of such calculation.

7. A copying machine with a photoreceptor having a capability of reproducing an image from an original at different magnifications on copying paper which machine comprises, in combination:

a first means for detecting the size of an original bearing an image to be reproduced on a copying paper;

a plurality of paper loading units;

a second means for detecting the size of copying papers loaded on each of the loading units;

a selector means for selecting one of the copying papers loaded on the respective loading units;

first and second storage means for the storing of a numerical figure representative of a predetermined magnification ratio having a predetermined number of digits;

a numerical input means for inputting the numerical figure to the first storage means through a predetermined manipulation;

a mode selector means for selecting one of the first and second operating modes in which the machine operates;

a magnification control means for controlling at least the magnification at which the image is projected onto a photoreceptor in response to the numerical figure stored in the first or second storage means; and a control means for causing the first storage means to be associated selectively with the magnification control means when the first operating mode is selected by the mode selector means and for, when the second operating mode is selected by the mode selecting means, calculating the magnification from the size of the original detected by the first detecting means and also the size of the copying paper detected by the second means to store a value obtained by the above calculation when the second storage means is selectively associated with the magnification control means.

8. A machine as claimed in claim 7, wherein said control means includes a regulating means for causing the value within a predetermined range of preset values to be stored in the first and second storage means such that, when the result of the calculation of the magnification is not within a predetermined range during the second operating mode, the second operating mode can be automatically released.

9. A machine as claimed in claim 7, further comprising a start means for starting a copying operation, which is operable to start the copying operation when the start operation is effected during the second operating mode and after a process to store the numerical figure in the second storage means has been completed.

10. A machine as claimed in claim 8, further comprising a start means for starting a copying operation, which is operable to start the copying operation when the start operation is effected during the second operating mode and after a process to store the numerical figure in the second storage means has been completed.

11. A machine as claimed in claim 1 further comprising a start signal output means for outputting a start signal necessary to initiate a copying operation, wherein when the numerical figure calculated by the calculating means is not included within the predetermined range, determined by the regulating means, the copying machine will not start the copying operation even after the start signal has been outputted.

12. A machine as claimed in claim 11, wherein when the numerical figure calculated by the calculating means is not included with the predetermined range, the copying machine is switched over to a mode in which the copying operation is performed regardless of the numerical data calculated by the calculating means.

13. A machine as claimed in claim 8, wherein when the numerical figure calculated by the calculating means is not included within the predetermined range, the copying machine has a search function for making a search to find whether or not copying paper of the same size as that of, but placed in a perpendicularly relationship thereto, exists the copying paper loaded on one of the loading units then selected is then loaded on a loading unit other than that selected.

14. A machine as claimed in claim 8 further comprising a start signal output means for outputting a start signal necessary to initiate a copying operation, wherein when the numerical figure calculated by the calculating means is not included within the predetermined range determined by the regulating means, the copying machine will not start the copying operation even after the start siganl has been outputted.

15. A machine as claimed in claim 14, wherein when the numerical figure calculated by the calculating means is not included with the predetermined range, the copying machine is switched over to a mode in which the copying operation is performed regardless of the numerical data calculated by the calculating means.

* * * * *

UNITED STATES PATENT OFFICE

CERTIFICATE OF CORRECTION

Patent No. 4,575,227 Dated March 11, 1986

Inventor(s) Ito, et al.

It is certified that error appears in the above-identified patent and that said Letters Patent are hereby corrected as shown below:

Column 16, line 44, after the phrase "calculating a magnification ratio from" insert --the size of the original detected by said detecting means and also--

Signed and Sealed this

Thirteenth Day of December, 1988

*Attest:*

DONALD J. QUIGG

*Attesting Officer*

*Commissioner of Patents and Trademarks*